US012690648B2

(12) United States Patent
Watry

(10) Patent No.: US 12,690,648 B2
(45) Date of Patent: Jul. 28, 2026

(54) BREAKAWAY POLE STRAP

(71) Applicant: Dynepic Sports, LLC, Sherwood, OR (US)

(72) Inventor: Krissa Elizabeth Watry, Reno, NV (US)

(73) Assignee: Dynepic Sports, LLC, Sherwood, OR (US)

( * ) Notice: Subject to any disclaimer, the term of this patent is extended or adjusted under 35 U.S.C. 154(b) by 334 days.

(21) Appl. No.: 18/539,849

(22) Filed: Dec. 14, 2023

(65) Prior Publication Data

US 2024/0115017 A1 Apr. 11, 2024

Related U.S. Application Data

(63) Continuation-in-part of application No. 17/962,815, filed on Oct. 10, 2022, now Pat. No. 11,878,233.

(51) Int. Cl.
*A45B 9/02* (2006.01)
*A63C 11/22* (2006.01)

(52) U.S. Cl.
CPC ..... *A45B 9/02* (2013.01); *A63C 11/2224* (2020.08); *A63C 11/2228* (2020.08); *A45B 2009/025* (2013.01)

(58) Field of Classification Search
CPC ..... A45B 9/02; A63C 11/22; A63C 11/2228; A63C 11/2224
USPC ..... 280/821
See application file for complete search history.

(56) References Cited

U.S. PATENT DOCUMENTS 3,290,049 A * 12/1966 Mcdonald ..... A63C 11/2224 280/821
3,451,688 A * 6/1969 Mcdonald ..... A63C 11/2224 280/821
3,995,872 A * 12/1976 Joseph ..... A63C 11/2224 280/822
4,252,344 A * 2/1981 Larsen ..... A63C 11/2224 280/822
4,315,641 A * 2/1982 Larsen ..... A63C 11/2224 280/822
4,742,837 A * 5/1988 Rise ..... F16M 13/08 135/66
5,326,134 A * 7/1994 Hiser ..... A63C 11/2224 24/17 AP
6,502,862 B1 * 1/2003 Lenhart ..... A45B 9/02 280/821

(Continued)

*Primary Examiner* — James A Shriver, II
*Assistant Examiner* — Hilary L Johns
(74) *Attorney, Agent, or Firm* — Shumaker, Loop & Kendrick, LLP; Patrick B. Horne

(57) ABSTRACT

A break-away wrist strap for a ski pole or the like. The wrist strap is comprised of a strap or cord material with a clip for attaching to the pole and a buckle for adjustment. The buckle allows adjustment of the size of a loop portion into which the user's hand is placed, and also allows adjustment of an extension portion which extends from the loop portion to the clip. The clip is configured to attach to a standard size pole below the main hand grip, and is designed to detach from the pole when a tensile force above a threshold amount is applied. The break-away feature improves safety of the wrist strap, allows the wrist strap to be used with existing poles, and allows the wrist strap to be removed when not needed. A storage clip for stowing the wrist strap against the pole is also provided.

24 Claims, 13 Drawing Sheets

(56) References Cited

U.S. PATENT DOCUMENTS 6,644,328 B1 11/2003 Lenhart
7,661,713 B2 * 2/2010 Panizza ..... A63C 11/2224 280/821
8,123,252 B2 2/2012 Lenhart
8,276,943 B2 * 10/2012 Best ..... F16F 15/022 135/65
9,370,685 B2 6/2016 Watry
D782,272 S 3/2017 Watry
9,713,759 B2 * 7/2017 Liebner ..... A63C 11/221
10,064,463 B2 * 9/2018 Kreis ..... A45B 9/02
10,118,084 B2 11/2018 Watry
10,286,251 B2 5/2019 Watry
10,863,804 B2 12/2020 Shintani et al.
11,026,486 B2 6/2021 Boing
11,325,019 B2 5/2022 Heim et al.
11,331,560 B2 * 5/2022 Heim ..... A63C 11/2224
11,696,627 B2 * 7/2023 Chen ..... A45B 9/02 135/65
2004/0185990 A1 * 9/2004 Orescan ..... A63B 69/36 482/121
2007/0120353 A1 * 5/2007 Panizza ..... A63C 11/2224 280/821
2011/0240077 A1 10/2011 Doherty et al.
2015/0265906 A1 9/2015 Takeuchi
2016/0220890 A1 * 8/2016 Liebner ..... F16B 2/10
2017/0231339 A1 * 8/2017 Kreis ..... A63C 11/2228 135/76
2020/0069009 A1 * 3/2020 Böing ..... A63C 11/2224
2020/0352290 A1 * 11/2020 Heim ..... A45B 9/02
2021/0228972 A1 * 7/2021 Heim ..... A63C 11/227
2022/0160086 A1 * 5/2022 Chen ..... A45B 3/00
2022/0258031 A1 * 8/2022 Marks ..... A63C 11/2228
2023/0309667 A1 * 10/2023 Böing ..... A63C 11/2224 135/65

* cited by examiner

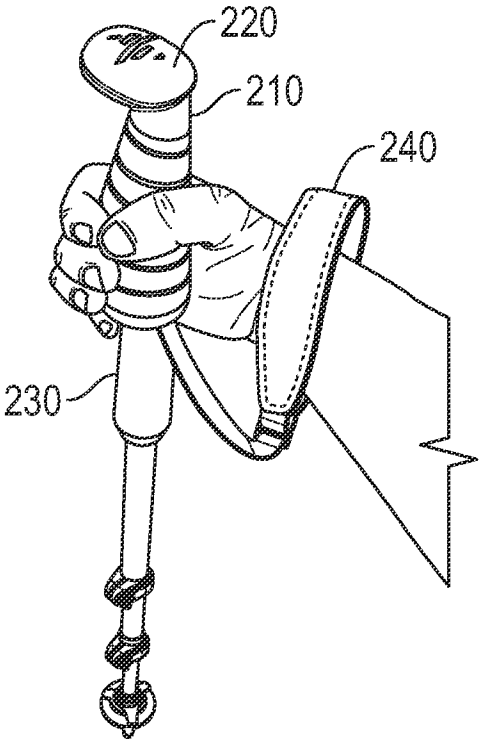
FIG. 5F
FIG. 5G
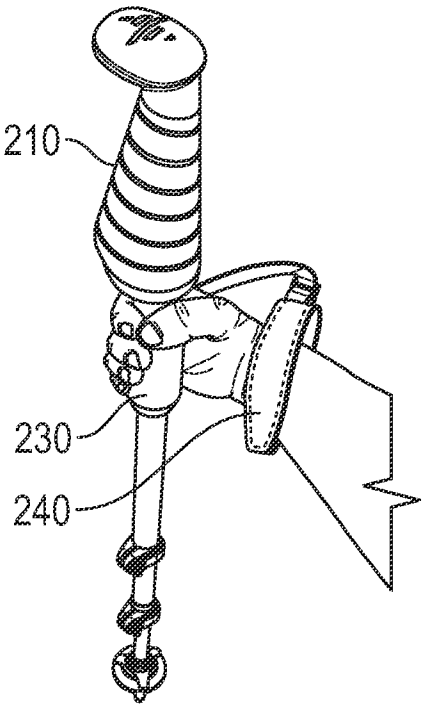
FIG. 5H

BREAKAWAY POLE STRAP

CROSS-REFERENCE TO RELATED APPLICATIONS

This application is a Continuation-In-Part of U.S. Utility patent application Ser. No. 17/962,815, titled POLE GRIP, filed Oct. 10, 2022.

BACKGROUND

Field

The present disclosure relates generally to an ergonomic, safe and effective wrist strap for a pole, such as a hiking, trekking or ski pole. More particularly, the disclosure relates to a wrist strap with a break-away coupling mechanism configured for detachably coupling to the pole below the hand grip.

Discussion of the Related Art

Hand grips attached to poles for hiking, trekking, skiing, or even just for stability when walking or standing, are used with varying degrees of comfort and effectiveness. FIG. 1 is an illustration of a hand grip 100 of a type known in the art. The hand grip 100 is typical of a design often used on a hiking or ski pole, even though the design is not a particularly desirable shape for optimum comfort or effectiveness. These grips include features such as finger locating bumps (indicated at 110) and indentations (120, 122) in an effort to encourage a certain placement of the hand on the grip during use. However, these design features do little to secure the hand in place when the pole strikes the ground and a load along the axis of the pole is applied to the hand. Prior art hand grips used in other applications—such as walking sticks and canes—have similar grips, and similar problems. Many of these prior art hand grips rely on the user to utilize the strap to react the load of the pole striking the ground. In these cases, many people fail to use the strap correctly to react the load because it is uncomfortable.

Prior art pole grip designs of the type shown in FIG. 1 require the user to tightly wrap their hand around the grip, which causes fatigue from the hand and forearm muscles being engaged. Additionally, achieving a tight grasp can be difficult when wearing the appropriate attire for the activity, e.g., ski gloves. Moreover, it is increasingly difficult to grasp these pole or cane grips when the user has conditions such as arthritis and cannot comfortably form a tight first around the grip. The reason that a tight grasp is required in prior art pole grip designs is that the grip has a shape where the surfaces of the grip are generally parallel to the axis of the pole. This means that reacting to an axial load on the pole—such as when the pole impacts the ground during the course of the activity—can only be achieved by friction forces on the surface of the grip. Friction force is a function of coefficient of friction and normal force, and the normal force is provided by the grasp pressure of the user. Thus, without a tight grasp, there is little friction force available to react to an axial load on the pole. This squeezing force required for a tight grasp causes hand and forearm fatigue which is not ideal in any circumstance, but especially considering that many of the activities using these grips are long duration activities—on the order of hours, if not days.

The hand grip 100 also includes an upper grip stop 130 and a lower grip stop 140. The grip stops are designed to provide a certain measure of axial force and prevent the hand from slipping off of the grip, where the upper grip stop 130 prevents the hand from sliding off the top of the grip and the lower grip stop 140 prevents the hand from sliding off the bottom of the grip. However, the grip stops 130 and 140 concentrate the reaction forces on a small portion of one finger, which is not ergonomically efficient or comfortable for the user.

Furthermore, existing pole grips typically have a wrist strap 150 which is fixedly attached near the top of the grip. Users often place their hand up through the wrist strap 150 and capture the strap 150 between the palm of the hand and a back 160 of the grip. The wrist strap 150 is then used to apply a downward force to the pole when pushing against the ground. The use of the wrist strap 150 in this way is necessitated by the inability of the user to apply a significant downward force to the pole via the grip itself and it uncomfortable on the hand. Many times, users just put their hand through the strap and directly grab the hand grip 100. In this case, the strap 150 does not react the ground impact loads and the hand grip 100 also does not effectively react the load without the user squeezing their hand, ultimately leading to grip fatigue. Also, using the wrist strap 150 in this ineffective hand position on the strap 150 to the hand grip 100 can result in injury to the hand—such as hyperextension of the thumb—if the user falls on the pole, since the hand becomes trapped in the wrist strap 150 and cannot clear the hand grip 100.

In addition to the axial load consideration described above, prior art pole grips of the type shown in FIG. 1 are not designed to fit naturally in a user's grasp, based on the anatomical properties of the human hand when closed gently into a grasping shape.

In view of the circumstances described above, there is a need for an improved pole grip, and an improved break-away wrist strap, for use on trekking and ski poles and the like.

SUMMARY

The present disclosure describes a break-away wrist strap for a pole, such as a ski pole or a trekking pole. The wrist strap is comprised of a piece of a strap material such as nylon webbing, along with a clip for attaching to the pole, and a buckle for adjustment. The buckle arranges the strap material into a loop portion into which the user's hand is placed and an extension portion which extends from the loop portion to the clip where attached to the pole. The buckle allows adjustment of the size of the loop portion, and also allows adjustment of the extension portion. The clip is configured to attach to a standard size pole below the main hand grip. The clip is also designed to detach from the pole when a tensile force greater than a certain amount is applied. The break-away feature improves safety of the wrist strap, allows the wrist strap to be used with existing poles, and allows the wrist strap to be removed when it is not needed by the user. The wrist strap may be provided as a component of a system with a pole having a conical primary grip and an optional lower ascent grip, or the wrist strap may be provided separately and used with any existing pole. A storage clip is also provided for stowing the entire wrist strap against the pole when the strap is not being used.

Additional features of the present disclosure will become apparent from the following description and appended claims, taken in conjunction with the accompanying drawings.

BRIEF DESCRIPTION OF THE DRAWINGS

FIGS. 5A-5H are illustrations of a human hand grasping the primary grip, the ascent grip or the grip top, depicting different types of grips which are possible using the pole grip system, according to embodiments of the present disclosure;

DETAILED DESCRIPTION OF THE EMBODIMENTS

The following discussion of the embodiments of the disclosure directed to a break-away pole strap is merely exemplary in nature, and is in no way intended to limit the disclosure or its applications or uses.

Hand grips for skiing and hiking poles and the like have traditionally been designed with a simple shape intended to position the fingers of the user's hand in a desired location on the grip, but which does little to transfer force from the hand along the axial direction of the pole. As a result, hand grips such as the one shown in FIG. 1 and discussed above use grip stops to prevent the user's hand from slipping off an end of the grip. These grip stops are not particularly effective at transferring high axial forces from the hand to the pole, as is needed when the pole is planted in the ground and pushed against, and the grip stops can create uncomfortable pressure points on the user's hand in some circumstances. In addition, existing hand grips can cause hand fatigue due to the mismatch between the shape of the grip and the natural shape of the user's grasp. Existing hand grips also lack desirable features in the wrist strap.

The pole grip system of the present disclosure is designed to overcome the shortcomings and limitations of existing hand grips for poles. The disclosed pole grip system features a conical grip shape which is designed to match the natural anatomical shape of the user's grasp. This conical shape reduces hand fatigue, and also enables the user to apply an axial force along the length of the pole without requiring excessive squeezing effort. That is, the conical grip shape serves as a wedge which allows the user's hand to apply an axial force (from the smaller diameter end toward the larger diameter end) without having to rely solely on grip pressure and friction or a strap to react the loads. The optimized grip shape in turn enables the wrist strap to be optionally installed and redesigned for user comfort, convenience, operational flexibility and safety. Other elements and features are also incorporated in the pole grip system and discussed below.

Figure 2:
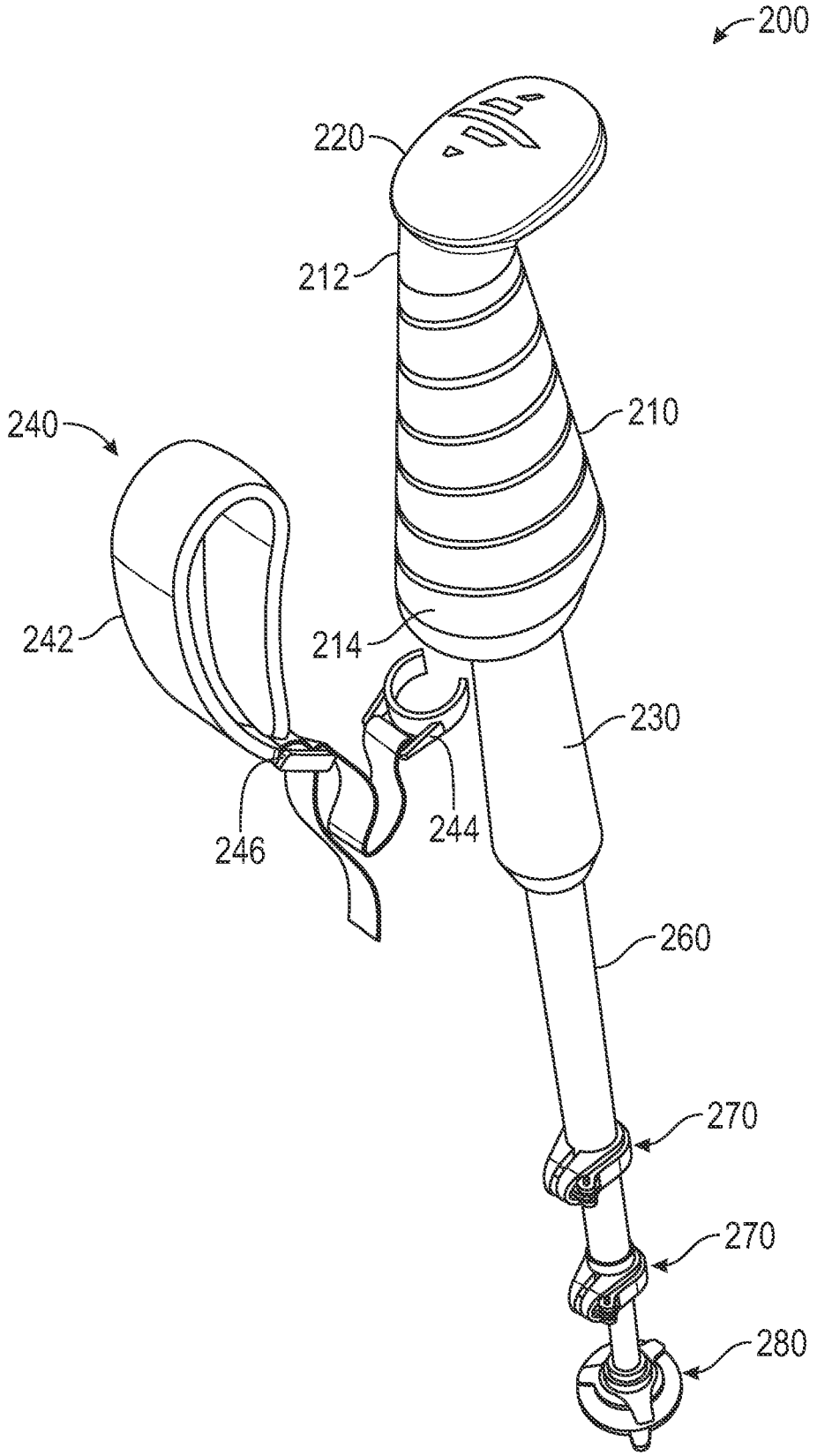
FIG. 2 is an illustration of a pole grip system having a conical primary grip with a multi-purpose grip top, a secondary ascent grip located just below the primary grip and a break-away wrist strap attached between the primary grip and the ascent grip, according to an embodiment of the present disclosure.

FIG. 2 is an illustration of a pole grip system 200 including a primary grip 210 having a conical shape, a multi-purpose grip top 220, a secondary ascent grip 230 located just below the primary grip 210, and a break-away wrist strap 240 attached between the primary grip 210 and the ascent grip 230, according to an embodiment of the present disclosure.

Figure 3B:
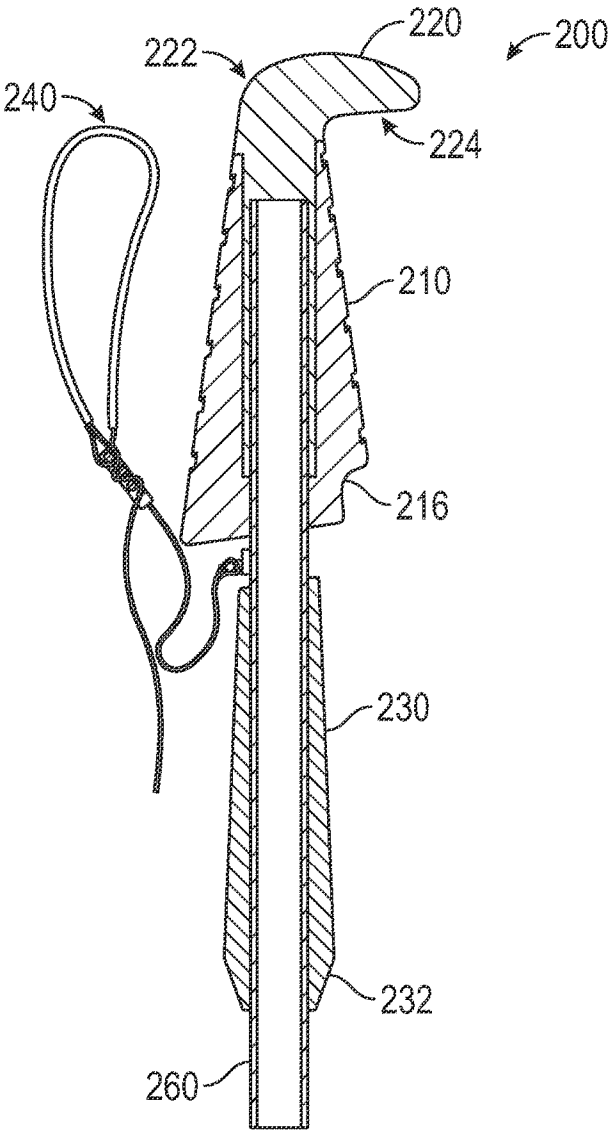
FIG. 3B is a cross-sectional side view illustration of the pole grip system of FIG. 3A, according to an embodiment of the present disclosure.
Figure 3A:
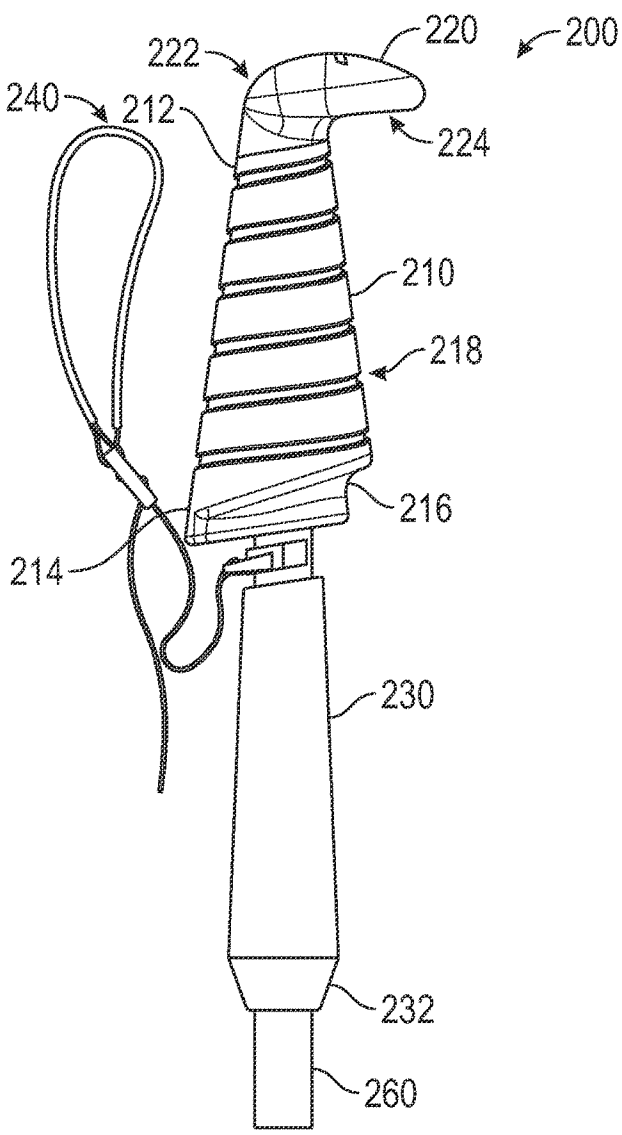
FIG. 3A is a side view illustration of the pole grip system shown in FIG. 1.

FIG. 3A is a side view illustration of the pole grip system 200, and FIG. 3B is a cross-sectional side view illustration of the pole grip system 200, according to an embodiment of the present disclosure.

The pole grip system 200 includes many elements and features which improve the pole usage experience for the user. The primary grip 210 has a conical shape which provides two major advantages. First, the conical shape of the primary grip 210 fits naturally in the hand of the user. The human hand, when closed into a grasping position, does not form a cylindrical shape, but rather naturally forms a conical shape—with the thumb and index finger forming an approximate circle at the top of the grip, and the palm and other fingers approximating a conical shape of increasing diameter going downward from the top of the grip. The primary grip 210 has a conical shape which matches the natural anatomical shape of the hand, thereby increasing hand-grip surface contact, and also reducing fatigue in the user's hand.

The second major advantage of the conical shape of the primary grip 210 is that the conical shape provides a mechanism for axial force to be transferred from the user's hand to the pole without requiring a tight grasp by the user. Many different types of outdoor sports and other activities use a pole for push-off and stability assistance. These activities include hiking, trekking, downhill (Alpine) skiing, cross-country (Nordic) skiing, backcountry skiing, snowshoeing, splitboarding (where a snowboard which is split down the middle is usable as either a snowboard or as a pair of skis), and even simply walking or standing. In any of the pole-assisted activities mentioned above, a downward force must be applied to the pole by the user's hand. This downward force—along the axis of the pole—may be quite large in the case of trekking or skiing, or relatively small in the case of walking. Prior art pole grips of the type shown in FIG. 1 rely on the use of a strap or the friction between the hand and the grip in order to apply the downward force on the pole. The friction is a function of normal force, which depends on grasp pressure.

In contrast, the primary grip 210 of the present disclosure has a conical shape which provides an axial surface area— essentially a wedge—against which the user's hand can bear. Another way to think of this is to imagine a first cone fitted inside of a second cone—where the first cone is physically blocked from moving any further once it contacts the interior surface of the second cone. This same effect applies to the conical primary grip 210 when it is fitted inside the grasp of the user's hand.

Friction forces between the user's hand and the primary grip 210 also come into play, and further increase the transfer of axial force from the hand to the grip (and thus the pole). Friction forces may be enhanced by way of material selection for the primary grip 210 (including surface tackiness and/or a slight compressibility of the material), and also by way of shape features on the surface of the primary grip 210—both of which are discussed below.

The primary grip 210 has a top end 212 and a bottom end 214. The top end 212, which is the smaller diameter portion of the conical shape, is proximal the top end of the pole to which it is fitted. In a preferred embodiment, the top end 212 has a diameter (just below the grip top 220) of about 1", plus or minus about 0.25". The 1" diameter of the top end 212 corresponds with the natural size of the grasp (the ring formed by the thumb and forefinger) by the hand of the majority of users. Larger and smaller diameters at the top end 212 are of course possible.

The bottom end 214 is the larger diameter portion of the primary grip's conical shape. The primary grip 210 has a preferred "length" (from the top end 212 to the bottom end 214) of about 5", not counting the height of the grip top 220. This grip length is designed to accommodate the width of the hand of most users. Grip lengths in a range from about 4-6" may be suitable in various applications. The primary grip 210 has a cone angle in a range from about 10-35°, with a preferred angle between 15-20°. In a most preferred embodiment, the primary grip 210 has a cone angle (the total included angle from outside surface to outside surface) of about 16°. Thus, the angle from the pole centerline to an outside surface of the primary grip 210 is about 8°, and in a particularly preferred embodiment this angle is 7.94°. The aforementioned dimensions result in the bottom end 214 having a diameter of about 2.5", plus or minus a small amount. Again, the bottom end diameter of about 2.5" corresponds with the natural size of the grasp by the hand of the majority of users (the lower portion of the grasp formed by the outer edge of the palm and the pinky finger, which naturally form an arc).

The conical portion of the primary grip 210, from the top end 212 down to the bottom end 214, is considered the grip body. Thus, the primary grip 210 in its entirety comprises the grip body and the grip top 220.

The cone angle of the primary grip 210 (e.g., 16°) is large enough to allow the user to apply a substantial axial thrust force to the pole without having to grasp tightly to create a friction force. This natural mechanism for applying a thrust force to the pole, without relying on friction, is a major advantage of the conical shape of the primary grip 210. Although larger cone angles for the primary grip 210 would increase the amount of axial surface area against which the user's hand could provide a thrust force, larger cone angles would also increase the weight of the pole grip system 200, and deviate from the natural shape of the user's hand in a grasping position.

The grip system 200 may be made in smaller youth and intermediate sizes to accommodate smaller hands, where all of the lengths and diameters discussed above would be reduced appropriately, and the cone angle would remain in the 15-20° range.

The primary grip 210 has a notch 216 extending around most of the circumference of the lower end 214, as shown best in FIG. 3A. The notch 216 is largest (in both height and depth of cut) at the front face of the primary grip 210. The front face is the portion of the primary grip 210 which is facing in the direction the user is traveling when using a conventional or regular grasp; this is located at the right in FIG. 3A, underneath a front overhang 224 discussed later. The circumferential shape allows the notch 216 to be used for a "pinky lift", where the little finger (pinky) is curled into the notch 216 and used to aid in lifting the pole. In this hand position the hand has a very relaxed open grip that can react the ground impact load but also easily lift the pole in preparation for the next step.

In a preferred embodiment, a spiral groove 218 is formed in the outer surface of the primary grip 210, running continuously in a spiral or helical shape from the top end 212 to the bottom end 214 as shown. The spiral groove 218 serves to wick or channel moisture (rain, snow, perspiration, etc.) away from the hand or glove of the user, thereby maintaining a drier grip surface and a more secure grasp. The spiral groove 218 also provides additional mechanical grip enhancement, as the hand or glove of the user will deform into the groove 218 slightly under normal grasp pressure.

The pole grip system 200, and the primary grip 210 in particular, must be designed to withstand the rigors of outdoor activities such as trekking and snow skiing. This implies a number of requirements which must be met by the pole grip system 200 and the primary grip 210—including being waterproof, generally impervious to dirt and dust, durability over years of usage, and ability to withstand impacts with the ground and rocks.

A variety of materials may be used for the primary grip 210, and the optimal material selection may depend on the activity for which the pole/grip are being used (snow skiing, hiking, walking, etc.). The primary grip 210 must largely maintain its shape in the user's grasp; that is, the grip material must not be too "squishy" or compressible. On the other hand, it is not desirable for the primary grip 210 to be extremely hard or slick. The ideal properties of the primary grip 210, for most usage applications, are a slight amount of compliance or compressibility and some degree of surface tackiness. In addition, the primary grip 210 must be as light in weight as possible, as pole/grip weight (lighter is better) are a primary consideration in long-duration activities such as trekking and cross-country skiing.

The properties described above may be achieved by constructing the primary grip 210 of natural cork or EVA (ethylene-vinyl acetate) foam, or a combination of rubber or soft plastic with cork or EVA foam. The aforementioned materials are particularly suitable to trekking or hiking activities. For snow skiing and other snow sports where moisture is unavoidable, a combination of a durable plastic with rubber, silicone rubber or an elastomer such as a TPE (thermoplastic elastomer) may be used, where the harder plastic would be used for inner parts of the primary grip 210 and the rubber or TPE would be used for the outer grip surface. Other materials may be used as suitable based on their hardness, durability, density, surface friction properties, ability to withstand moisture and impacts, etc.

The grip top 220 has a size and shape specifically designed to match certain grasp styles by the user (discussed below), thus enhancing the performance of the pole-grip combination and the comfort for the user. One feature of the grip top 220 which is highly advantageous in several of the grasp styles is a blend surface 222 which provides a transition from a top surface of the grip top 220 to a trailing (or rear) surface at the top end 212 of the primary grip 210. The blend surface 222 is a smooth, continuous blend—with no overhang of the primary grip 210 in the trailing direction. The reasons for the blend surface 222 being designed this way—relative to both performance and comfort—will be discussed with respect to the various grasp styles below.

The grip top 220 further includes a front overhang 224, which is also designed for performance and comfort in various grasps. A bottom surface of the front overhang 224 serves as a top grip stop and hand positioning feature for a conventional grasp, where the bottom surface of the front overhang 224 provides a large surface area for lifting the pole with the top of the user's index finger. A top surface of the grip top 220 is designed with a rounded shape to fit the palm of the user's hand when using a "palm grip", where the user achieves forward thrust by pushing down on the grip top 220 with the pole angled down and rearward to the tip which is planted in the ground. These features of the grip top 220 and their relevance to the various grasp styles are also discussed further below. The grip top 220 may be constructed of the same material as the primary grip 210, or the grip top 220 and the primary grip 210 may be made of different materials. One-piece and two-piece construction embodiments are discussed below.

The ascent grip 230 is an optional element of the pole grip system 200. The ascent grip 230 is particularly useful in activities involving uphill climbing—such as trekking and some types of backcountry skiing. A shorter pole length is desirable when planting the pole during uphill climbing. This is one reason for poles having adjustable lengths. However, it is inconvenient for the user to adjust the pole length, and therefore this is usually only done prior to a prolonged period of uphill climbing. In more typical conditions, where short periods of uphill climbing are interspersed with traversal of flat or downhill terrain, it is far easier for the user to simply grasp the ascent grip 230 to effectively shorten the pole length for the uphill climbs.

The ascent grip 230, like the primary grip 210, also has a conical shape. The ascent grip 230 has a length (along the axis of the pole) of about 5 inches, more or less, which is designed to fit the width of the human hand. In a preferred embodiment, the ascent grip 230 has a top diameter of a little less than an inch—such as about 0.9 inches. The ascent grip 230 has a cone angle of about 4-5°, which is considerably less than the cone angle of the primary grip 210; this is so that the ascent grip 230 is less bulky, which makes it less of a hindrance to clipping two poles together, and allows it to be lighter in weight, among other advantages. In a preferred embodiment, a conical chamfer 232 is provided at the lower end of the ascent grip 230, to provide a transition in size back to the pole diameter.

The ascent grip 230 may be constructed of a material such as EVA foam or cork, preferably a single piece of material which is slipped or pressed into position on the pole and bonded in place. Other construction embodiments may also be suitable, such as a two-piece clamshell design which could be installed on a pole which already has the primary grip 210 installed.

A pole 260 is not part of the pole grip system 200 per se, but is used with the pole grip system 200. A pole including all of the components of the pole grip system 200 may be assembled and sold as a complete product, or the components of the pole grip system 200 may be sold as a kit which can be installed onto a user's own poles. In applications such as trekking, the pole 260 may include clamps 270 at one or more locations to allow for length adjustment. For other activities, the pole 260 is a single piece, not adjustable in length. The pole 260 may be made of carbon fiber tube, aluminum tubing, solid wood, bamboo, a composite material, or other rigid material with proper strength for the activity and forces applied. The pole 260 has a tip end 280 usually including a hard tip to penetrate the ground surface and a "basket" or cup-shaped element to prevent the tip end 280 from penetrating too far into soft soil or snow. For canes and walking sticks, the tip end 280 typically includes a simple rubber cap rather than the hard tip and the basket.

The break-away wrist strap 240 is detachably connected to the pole 260 between the primary grip 210 and the ascent grip 230, as shown in FIG. 3A. The break-away wrist strap 240 is shown in a detached position in FIG. 2. The break-away wrist strap 240 includes a loop portion 242 and a clip 244, among other elements. The user places their hand through the loop portion 242 so that the loop portion 242 is positioned over the user's wrist. The user can then grasp either the primary grip 210 or the ascent grip 230, because both are equally accessible based on the attachment location of the wrist strap 240 to the pole 260. This is in contrast to the traditional pole grip 100, where the wrist strap 150 is attached at the top of the grip handle and must be removed from the wrist if the user wishes to grasp the pole below the grip handle. A buckle 246 is also provided for adjustability of the break-away wrist strap 240.

The clip 244 enables the break-away wrist strap 240 to be reliably attached to the pole 260 when desired, and to be detached from the pole 260 when not wanted by the user. Very significantly, the clip 244 enables the break-away wrist strap 240 to detach from the pole 260 in the event that the user falls and a force is applied to the loop portion 242 pulling the wrist strap 240 away from the pole 260. This is a scenario which commonly occurs when the user falls on the pole 260. With traditional fixed wrist straps if the user grabs the pole through the strap, when the user falls on the pole, the user's hand is trapped in the wrist strap and is forced into the ground, sometimes in an awkward position and with the user's body weight landing on top, which can result in "skier's thumb" (jamming or hyperextension of the thumb) or other injuries. In contrast, the wrist strap 240 is configured at the base of the grip 210 which allows the hand to naturally clear the pole grip if the user falls, thus preventing injuries resulting from the user's hand from being trapped against the pole or the ground in a fall. As added safety feature, the break-away wrist strap 240 breaks free under tension and allows the hand to decouple from the pole 260 altogether. In addition, the break-away feature of the wrist strap 240 allows the use of the hand (free of the pole) to brace the user in the fall—such as to prevent the head from striking the ground.

The clip 244 is designed to provide a break-away force in a desired range, where the clip 244 does not detach unintentionally, but the clip 244 reliably detaches in the event of a fall. Other attachment means between the break-away wrist strap 240 and the pole 260 may be used as suitable. The break-away wrist strap 240 is connected to the pole 260 just below the primary grip 210, regardless of whether the (optional) ascent grip 230 is used. Additional design and construction details of the break-away wrist strap 240 are discussed later in connection with FIG. 6.

Figure 4B:
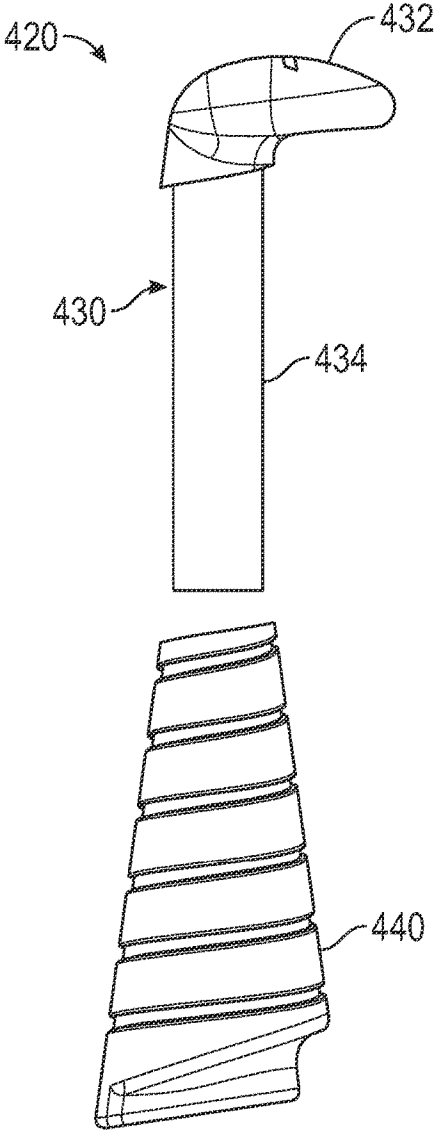
FIG. 4B is a side view illustration of a two-piece design of the primary grip of the pole grip system, according to embodiments of the present disclosure.
Figure 4A:
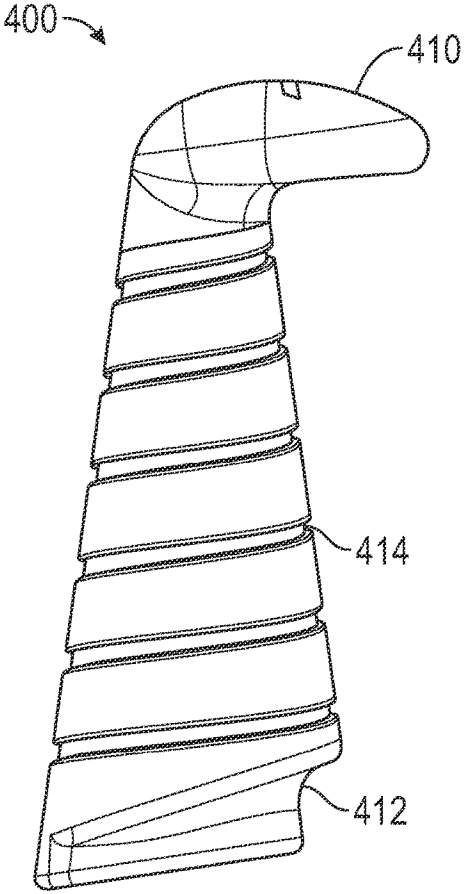
FIG. 4A is a side view illustration of a single-piece design of the primary grip of the pole grip system.

FIG. 4A is a side view illustration of a single-piece design of the primary grip of the pole grip system 200, and FIG. 4B is a side view illustration of a two-piece design of the primary grip of the pole grip system 200, according to embodiments of the present disclosure. A one-piece primary grip 400 is shown in FIG. 4A, and is an embodiment of the primary grip 210 shown in FIGS. 2 and 3 and described above. The one-piece primary grip 400 may be made of cork, EVA foam, rubber or a rubber-like plastic. A composite construction is also possible—such as an inner core molded of a harder plastic material with an outer body over-molded in EVA foam or the like. The one-piece primary grip 400 could even be 3D printed of any suitable material or combination of materials. The one-piece primary grip 400 includes an integral grip top 410, and also includes a notch 412 for the pinky finger lift as discussed earlier. A spiral groove 414 is shown traversing the surface of the one-piece primary grip 400, as also discussed above. The one-piece primary grip 400 is installed by sliding the grip 400 over the top end of the pole 260, where the grip 400 is coupled to the pole 260 by press fit (friction) or by bonding with an adhesive.

A two-piece primary grip 420 is shown in FIG. 4B, and is another embodiment of the primary grip 210 shown in FIGS. 2 and 3 and described above. The two-piece primary grip 420 comprises two parts; a pole coupler 430 with integrated grip top 432, and a grip body 440. The pole coupler 430 is a single piece including the grip top 432 and a coupler sleeve 434. The pole coupler 430 may be constructed of a durable and somewhat rigid material—such as rubber, plastic or TPE. The grip body 440 may be constructed of cork or EVA foam, for example, and is preferably made of a lighter (less dense) material compared to the pole coupler 430. For installation of the two-piece primary grip 420, the grip body 440 is fitted over the coupler sleeve 434 of the pole coupler 430, and the coupler sleeve 434 is fitted over the top end of the pole 260, where both of these assembly steps may be a press fit or may use an adhesive.

In both the one-piece and two-piece embodiments of the primary grip, the pole 260 is fitted into a hole in the lower end of the primary grip (400 or 420) such that the pole 260 extends most of the way up to the top end 212 (FIG. 2), but does not penetrate through the top of the grip top 220.

FIGS. 5A-5H are illustrations of a human hand grasping the primary grip 210, the ascent grip 230 or the grip top 220, depicting different types of grips or grasps which are possible using the pole grip system 200, according to embodiments of the present disclosure. The pole grip system 200 is designed to accommodate the multitude of grasp types depicted in FIGS. 5A-5H because users want to be able to move their hands into different grasp positions in order to reduce fatigue while trekking or climbing. Additionally, some grips are better for certain situations or activities; for example, level cross-country skiing may call for a different grasp type than downhill or slalom skiing, and uphill climbing may call for a different grasp type than mall walking.

Figure 5C:
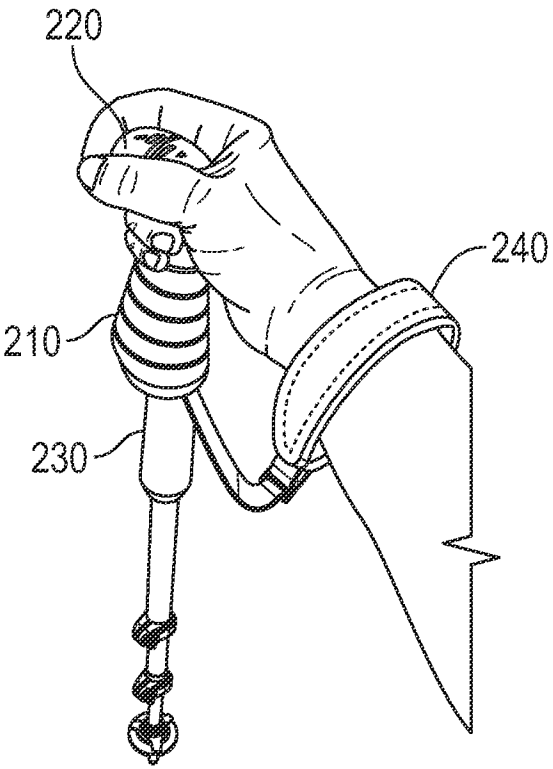
Figure 5B:
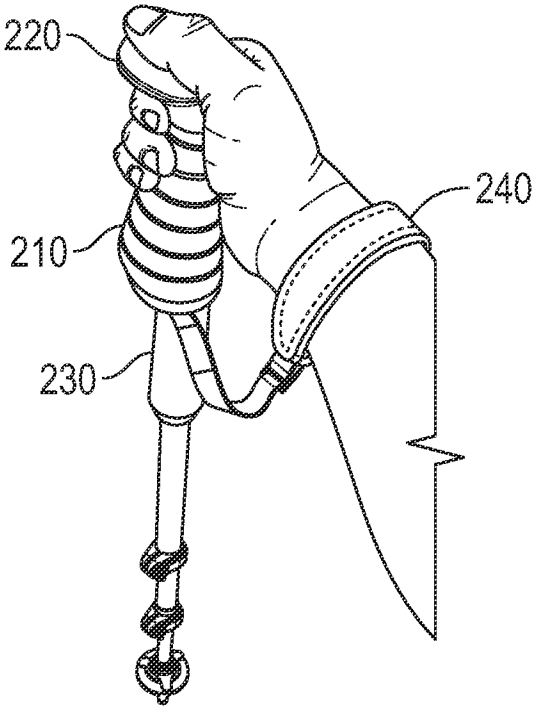
Figure 5A:
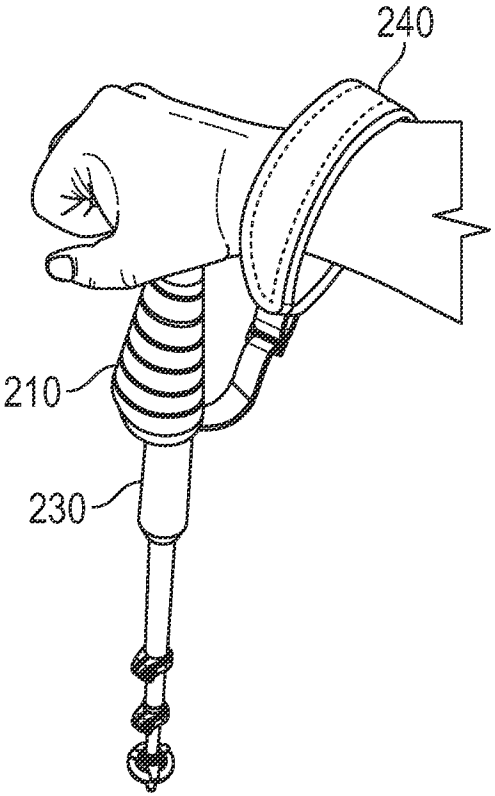

FIG. 5A illustrates a palm grip, where the hand is placed, palm down, on top of the grip top 220. The grip top 220 (not shown, obscured by hand) is designed with a rounded "dome" shape on top to accommodate the palm grip as shown in FIG. 5A. The palm grip is often used in steep climbs while hiking, and in certain cross-country skiing situations.

FIG. 5B illustrates a "power thumb grip", where the thumb is positioned on top of the grip top 220 and the fingers are wrapped around the upper portion of the primary grip 210. The rounded shape of the top of the grip top 220, along with the blend surface 222 (FIG. 3A)— a smooth, continuous blend with no rear overhang—provide a natural fit to the user's hand when using the power thumb grip as shown in FIG. 5B. The power thumb grip may be used as an alternate to a standard or regular grip in certain hiking, trekking and skiing situations—enabling the user to change hand grasping positions at intervals over the course of a long-duration activity.

FIG. 5C illustrates a "trigger grip", where the forefinger is wrapped around the periphery of the grip top 220 and curled into a trigger position at the leading edge, with the thumb also wrapped around the edge of the grip top 220 opposite the forefinger, and the other fingers are wrapped around the upper portion of the primary grip 210. The smooth, continuous blend with no overhang at the rear of the grip top 220 provides a comfortable fit to the user's hand when using the trigger grip as shown in FIG. 5C. The trigger grip may be used as an alternate to a regular grip or the power thumb grip in certain hiking, trekking and skiing situations.

The wrist strap 240, with its attachment location just below the primary grip 210, can easily accommodate all of the grasps shown in FIGS. 5A-5C.

Figure 5E:
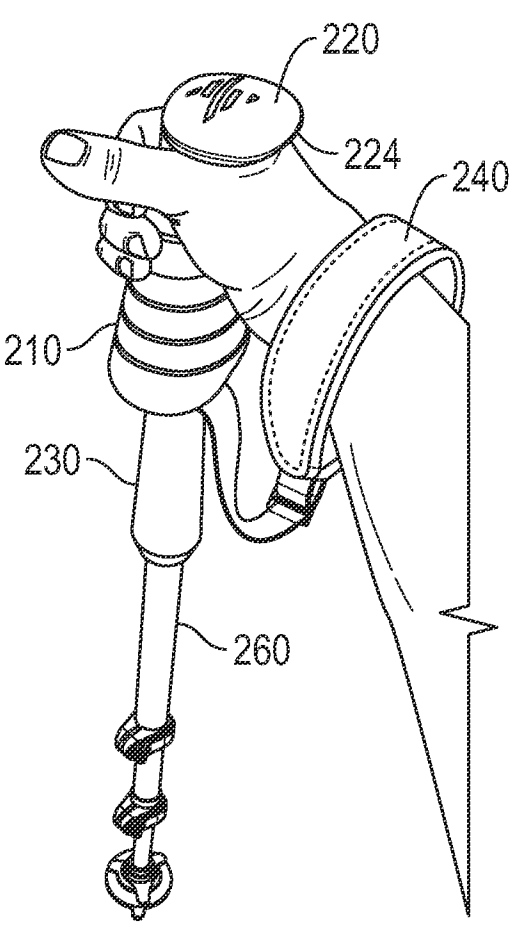
Figure 5D:
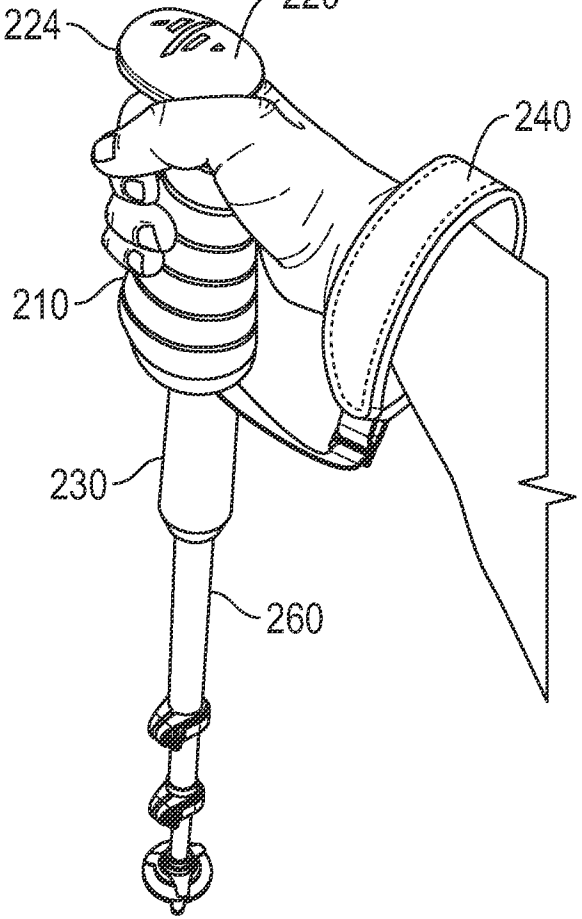

FIG. 5D illustrates a standard or regular grip, where the fingers are wrapped around the primary grip 210 and the thumb is wrapped around the opposite side of the primary grip 210, with the front overhang 224 of the grip top 220 pointing forward (in the direction of travel). The conical shape of the primary grip 210 provides a natural fit to the user's hand when grasping with the regular grip as shown in FIG. 5D. The regular grip is commonly used in many hiking, trekking and skiing situations—where the primary grip 210 offers a relaxed and ergonomic hand pose while providing a natural mechanism for delivering axial force from the hand to the pole 260.

FIG. 5E illustrates a "switch grip", where the fingers are wrapped around the primary grip 210 and the thumb is wrapped around the opposite side of the primary grip 210, with the front overhang 224 of the grip top 220 pointing rearward (opposite the direction of travel). The switch grip is an alternative to the regular grip which has a slightly different feel to the user, while still offering all of the comfort and performance benefits of the conical shape of the primary grip 210.

The wrist strap 240, with its clip attachment to the pole 260, can rotate around the pole 260 to accommodate either the regular grip of FIG. 5D or the switch grip of FIG. 5E.

FIG. 5F illustrates a "pinky lift" grasp, where the little finger ("pinky") is wrapped around the front of the primary grip 210, in the notch 216, and the other fingers are wrapped around the lower portion of the primary grip 210, with the thumb wrapped opposite the fingers. FIG. 5G illustrates a "two finger lift" grasp, which is similar to the pinky lift except in the two finger lift it is the ring finger which is positioned in the notch 216, with the pinky below the ring finger. The notch 216 is designed—in depth, width and curvature—to comfortably wrap a finger into, while other fingers grasp the body of the primary grip 210. The pinky lift and two finger lift grasps are useful when the user wants the most open, relaxed hand position.

Figure 1:
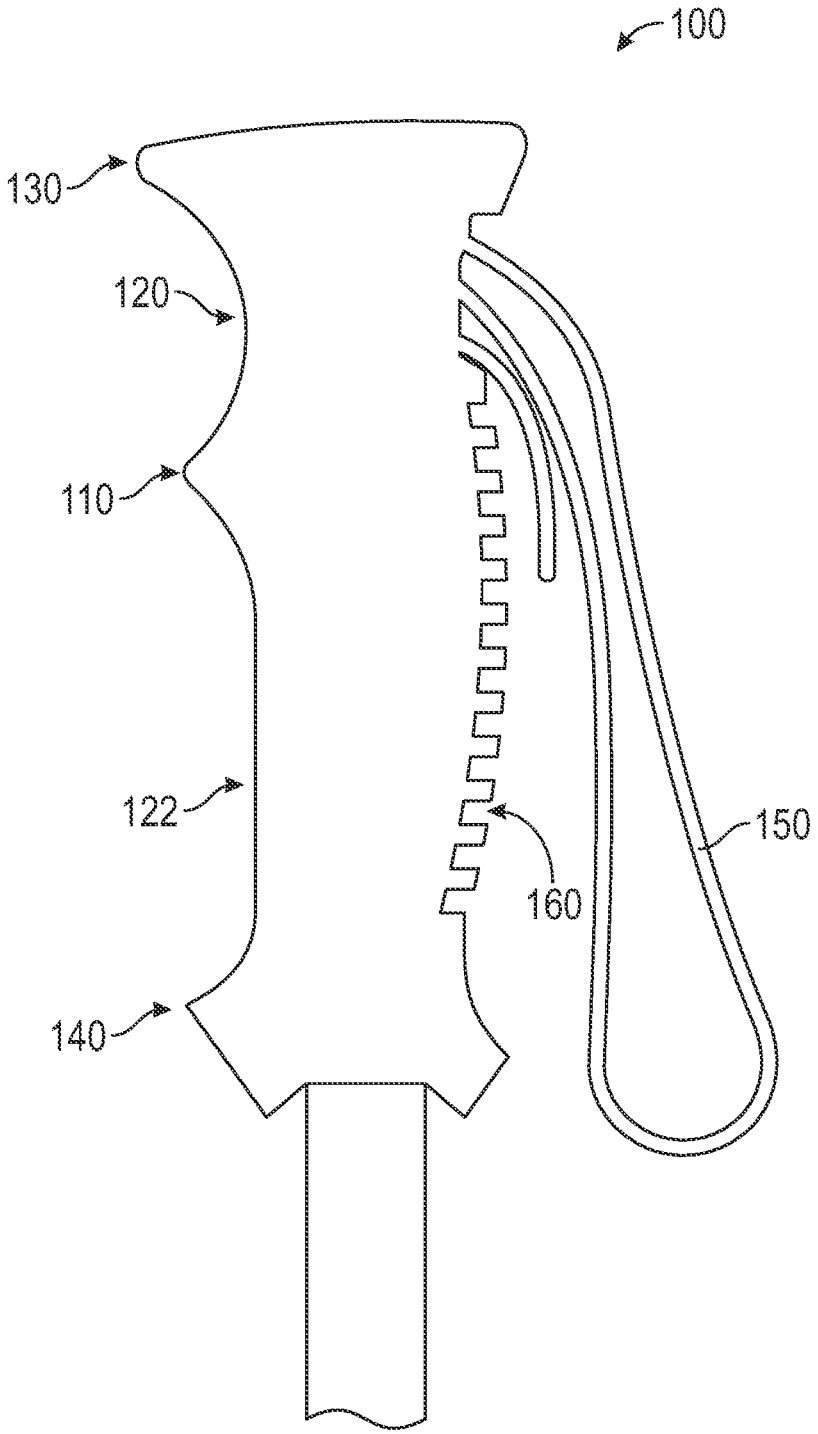
FIG. 1 (Prior Art)
FIG. 1 is an illustration of a conventional hand grip of a type used on ski poles and hiking poles, as known in the art.

FIG. 5H illustrates a regular grasp on the ascent grip 230, where the fingers are wrapped around the ascent grip 230 and the thumb is wrapped around opposite the fingers. The conical shape of the ascent grip 230 provides the same comfort and performance advantages as the primary grip 210. Although the ascent grip 230 is an optional component of the pole grip system 200, it is useful in situations where a shorter effective pole length is desired—including moderate ascents in hiking and trekking. The wrist strap 240, with its attachment location just above the ascent grip 230, can easily accommodate the grasp shown in FIG. 5H, while a conventional wrist strap as shown in FIG. 1 will not reach a lower grasp location such as this.

Figure 6:
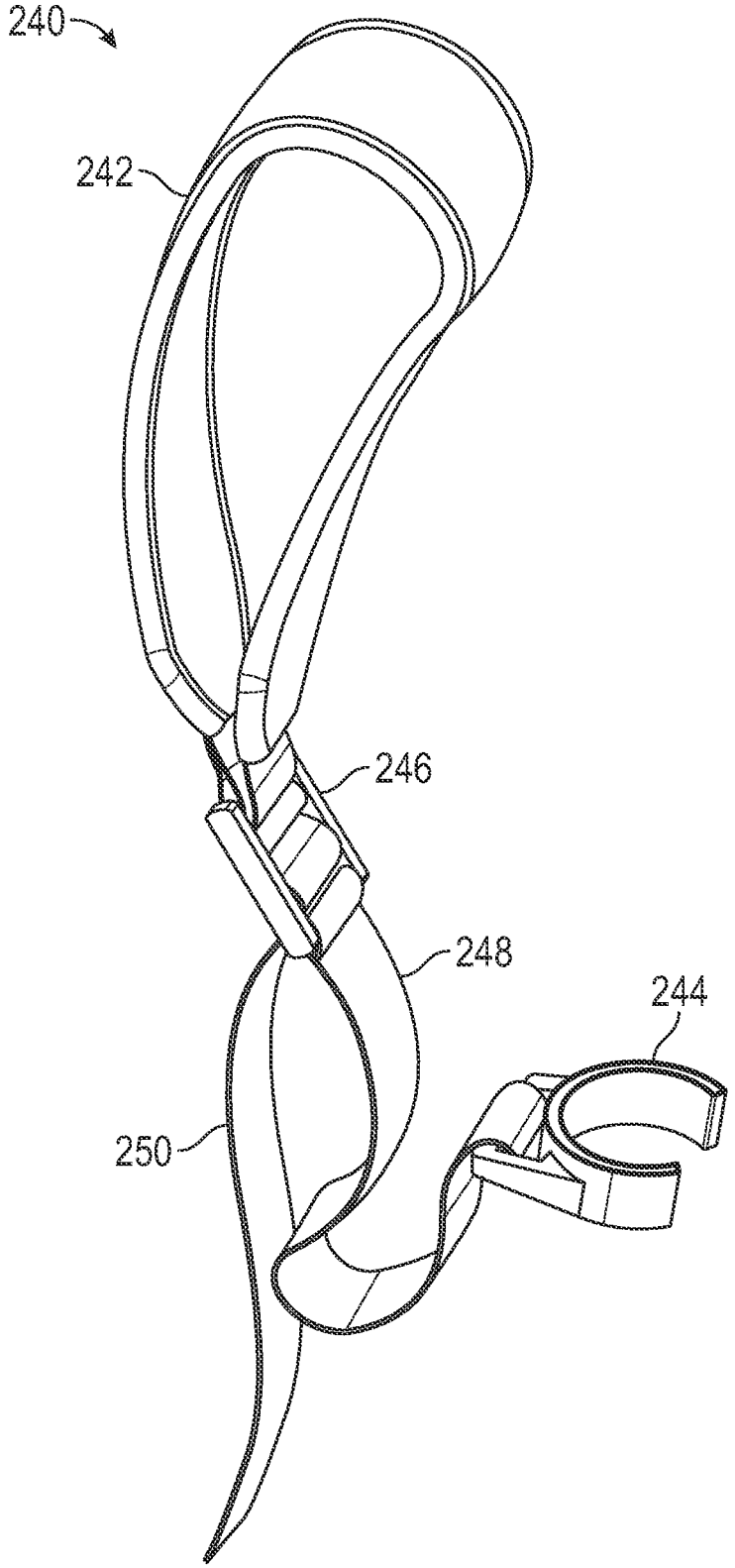
FIG. 6 is an illustration of the break-away wrist strap of the pole grip system, according to an embodiment of the present disclosure.

FIG. 6 is an illustration of the break-away wrist strap 240 of the pole grip system 200, according to an embodiment of the present disclosure. The break-away wrist strap 240 includes the loop portion 242, the clip 244 and the buckle 246 as mentioned earlier. A key feature of the wrist strap 240 is that it will break away (detach) from the pole 260 in the event of a moderate to hard pull on the clip 244. The break-away feature of the wrist strap 240 is made possible by the fact that the wrist strap 240 is not used to apply a downward force to the pole as in conventional grips and wrist straps of the type shown in FIG. 1. The conical shape of the primary grip 210 provides the pole thrust mechanism directly from the user's hand, which eliminates the need to use the wrist strap to assist in applying force to the pole, which in turn enables the break-away feature. The clip 244 is a preferred means of attaching the wrist strap 240 to the pole 260; however, any attachment means which supports light tension forces (such as using the wrist strap 240 to carry the pole 260), but breaks away under higher tension force, may be used.

The fact that the wrist strap 240 is not used to apply a downward force to the pole 260 also allows the wrist strap 240 to be attached at the bottom of the primary grip 210 rather than at the top of the grip and pole. Attachment of the wrist strap 240 at the bottom of the primary grip 210 enables the wrist strap 240 to be used when grasping the ascent grip 230 as well as the primary grip 210.

With the pole grip system 200, the wrist strap 240 is used essentially as a "keeper" strap—that is, to keep the pole 260 in position near the hand of the user even when the user releases her/his grasp on the primary grip 210 and the ascent grip 230. The user may wish to ungrasp but maintain control of the pole 260 for many reasons—such as moving the hand to a new grasp position (including switching between the primary grip 210 and the ascent grip 230), removing a glove and/or operating a mobile device, gesturing, etc. The wrist strap 240 also may be removed during pole usage and replaced during storage.

The wrist strap 240 is preferably comprised of a single piece of a strap material such as nylon webbing, along with the clip 244 and the buckle 246. The buckle 246 is preferably a compound buckle of a type which provides adjustability of the size of both the loop portion 242 and an extension portion 248. Using the buckle 246, the size of the loop portion 242 can be adjusted to just fit over the hand/glove of the user, where the size of the loop portion 242 will need to be considerably larger for a large man than for a small woman or a child. Similarly, different users may have different preferences for the length of the extension portion 248, which dictates the amount of slack that is present between the pole 260 and the user's wrist. In one embodiment, the length of the extension portion 248 is first set by adjusting the buckle 246 relative to the clip 244, where this first adjustment affects the length of the loop portion 242 as strap material is fed one direction or the other through the buckle 246. The length of the loop portion 242 can then be adjusted by feeding a free strap end 250 one direction or the other through the buckle 246. Other adjustment means besides the buckle 246 as described above may be suitable, with a strong preference for the independent adjustability of both the loop portion 242 and the extension portion 248. In some embodiments the extension portion 248 is a set length that is not adjustable and relies on the adjustability of the loop portion 242 to comfortably fit the loop around the wrist.

The loop portion 242 may include padding over the strap material to increase user comfort. In a preferred embodiment, the clip 244 is captured in a small fixed loop which is sewn into an end of the extension portion 248. The clip 244 is a simple, reliable and cost effective means of detachably coupling the wrist strap 240 to the pole 260. However, other detachable coupling means may be used as suitable.

As mentioned earlier, the break-away wrist strap 240 may be removed from the pole 260 in situations where the wrist strap 240 is not needed or wanted. As such, the break-away wrist strap 240 is an optional component of the pole grip system 200. Additionally, the break-away wrist strap 240 may be provided separately and utilized with a user's existing pole, where the break-away feature and the ability to connect the strap to the pole below the main grip provide advantages over existing wrist straps.

As detailed above, the pole grip system of the present disclosure provides many advantages over existing hand grips for skiing, hiking and trekking poles. The disclosed pole grip system features a conical grip which is designed to match the natural anatomical shape of the user's grasp. This conical grip shape reduces hand fatigue, and also enables the user to apply an axial force along the length of the pole without requiring excessive squeezing effort. The optimized grip shape in turn enables the wrist strap to be redesigned for user comfort, convenience, operational flexibility and safety. Other shape features of the primary grip, plus an optional ascent grip, deliver even more advantages over existing pole grip designs.

The preceding discussion discloses a pole grip system having elements and features not found in existing pole grips—including disclosure of the break-away wrist strap 240 which was shown in several of the figures described above. This preceding discussion focused mainly on the use of the break-away wrist strap 240 in conjunction with the other elements of the pole grip system 200—such as the primary grip 210 and the ascent grip 230. However, as mentioned above, the break-away wrist strap 240 may be provided separately and utilized with poles having convention grip designs, where the break-away feature and the ability to connect the strap to the pole below the main grip provide advantages over existing wrist straps. This is discussed further below.

Figure 7A:
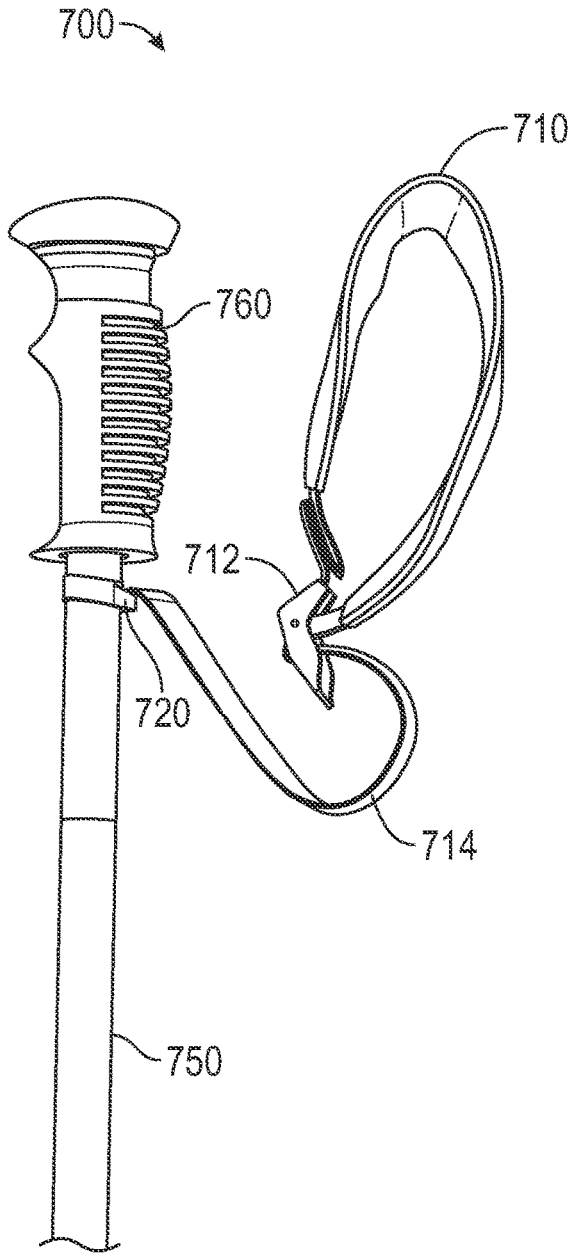
FIG. 7A is an illustration of a break-away wrist strap connected to a conventional pole.
Figure 7B:
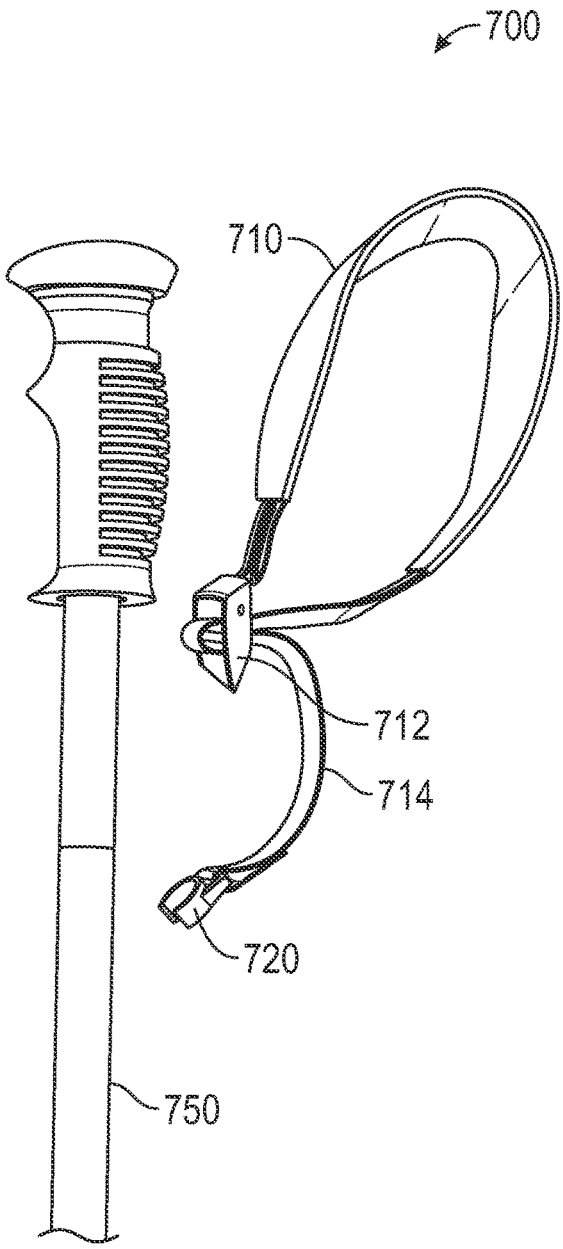
FIG. 7B is an illustration of the break-away wrist strap detached from the pole, according to embodiments of the present disclosure.

FIG. 7A is an illustration of a break-away wrist strap 700 connected to a conventional pole 750, and FIG. 7B is an illustration of the break-away wrist strap 700 detached from the pole 750, according to embodiments of the present disclosure. The pole 750 includes a grip 760, which could be any type of hand grip or grip system, as discussed further below. The wrist strap 700 generally corresponds with the wrist strap 240 of earlier figures, having the same key features. The wrist strap 700 includes a loop portion 710, a buckle 712, an extension portion 714 and a clip 720, equivalents of which were discussed earlier with respect to the wrist strap 240. The buckle 712 arranges a piece of strap material into the loop portion 710 and the extension portion 714. The wrist strap 700 does not include a free strap end as was shown on the wrist strap 240 but, as would be understood by those familiar with adjustable strap systems, the inclusion of a free strap end versus a different type of buckle arrangement interconnecting the extension portion 714 with the loop portion 710 is simply a matter of design choice.

A clip 720 is sized and shaped for clipping onto the pole 750. The clip 720 corresponds with the clip 244 of FIG. 6. In a preferred embodiment, the clip 720 has a C-shaped design and is formed of a plastic material. The clip 720 easily snaps into position over the outer diameter of the pole 750 by simply pressing an opening of the C-shape of the clip 720 against the pole 750; this is clearly apparent in the illustration of the clip 244 in FIG. 6. The clip 720 (or 244) has internal walls in a cylindrical shape, with a diameter slightly smaller than the outer diameter of the pole 750—so that the clip 720 maintains a clamping force when positioned on the pole 750. The clip 720 detaches from the pole 750 when a tensile load of a certain magnitude is applied to the extension portion 714. The clip 720 is designed, such as by selection of cross-sectional thickness and material, to achieve a desired value for the magnitude of force which will detach the clip 720 (and thus the wrist strap 700) from the pole 750.

The break-away wrist strap 700 offers several features not available with existing wrist strap designs. First, the wrist strap 700 prevents injuries such as "skier's thumb"—which occurs when a skier (or a pole user engaged in hiking or other such activities) falls and the user's hand is trapped in the fixed wrist strap and is forced into the ground, sometimes in an awkward position and with the user's body weight landing on top. The break-away feature of the wrist strap 700 prevents any such injury, and allows the user to use their hand (free from the pole) to brace against the fall.

Second, the wrist strap 700 attaches to the pole 750 below the grip 760. This means that the wrist strap 700 is not dangling in the way when the user wants to grasp the grip 760. Conventional wrist straps are fixedly attached at the top of the grip 760 (see FIG. 1), which means that the user must contend with the presence of the conventional wrist strap whether the user intends to use the wrist strap or not. By attaching to the pole below the grip 760, the wrist strap 700 resolves this nuisance, while keeping the wrist strap 700 positioned in a location convenient for access by the user's hand. In addition, conventional top-mounted wrist straps, lacking an extension portion between the loop and the grip, compel the user to place only their fingers and palm through the loop and squeeze part of the wrist strap against the grip. This is uncomfortable and defeats any natural ergonomic shape of the grip. In contrast, the wrist strap 700 is configured, with the loop portion 710 and the extension portion 714, to enable the user to place their hand completely through the wrist strap 700, resulting in an unencumbered grasp of the hand grip, as shown in FIG. 5D for example.

Third, the wrist strap 700 is completely detachable from the pole 750, for situations where the skier or hiker does not want a wrist strap. The wrist strap 700 could be used for a portion of a trekking expedition, and detached from the pole 750 and kept in the user's pocket for another portion of the expedition, for example. The wrist strap 700 can also be stowed, fixed at both ends flat against the pole 750, as discussed further below. The wrist strap 700 also serves as a convenient loop for hanging the pole 750 for storage, even if the wrist strap 700 is only occasionally used during skiing and trekking.

Fourth, the wrist strap 700 can be used with existing ski poles and trekking poles—either poles which did not originally have a wrist strap, or poles which include a wrist strap that the user does not care for. By clipping directly onto the pole, which is known to have a diameter within a small range of standard sizes, the wrist strap 700 provides a nearly universal compatibility and fit.

The adjustability of the loop portion 710 and the extension portion 714, using the buckle 712, have been discussed previously with respect to the equivalent components of the wrist strap 240 of FIG. 6. As with the wrist strap 240 of FIGS. 2, 3 and 5, the wrist strap 700 can be used in conjunction with the conical primary grip 210 and the optional lower ascent grip 230, where in this situation the wrist strap 700 is clipped to the pole in the small space between the primary grip 210 and the ascent grip 230. The wrist strap 700 may also be used with any ski pole or trekking pole having a conventional hand grip, such as the grip 760 on the pole 750 of FIG. 7.

Figure 8:
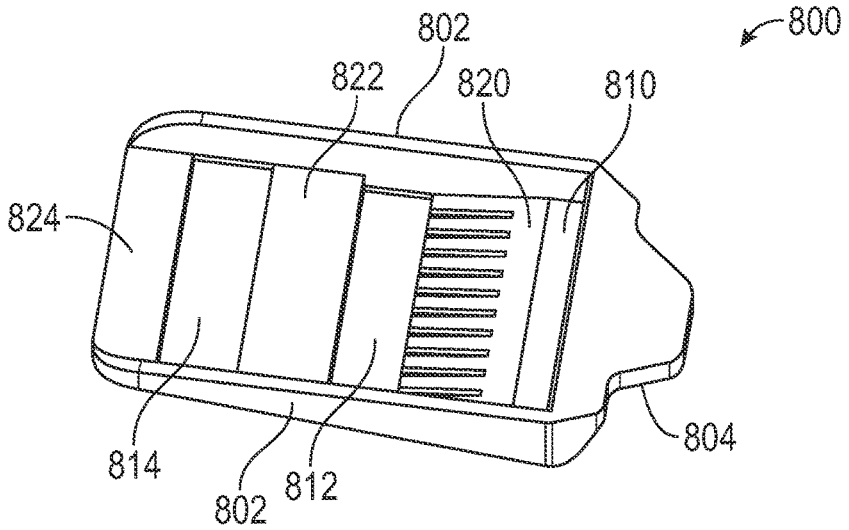
FIG. 8 is an illustration of a buckle providing dual sizing adjustability of a wrist strap, according to an embodiment of the present disclosure.
Figure 9:
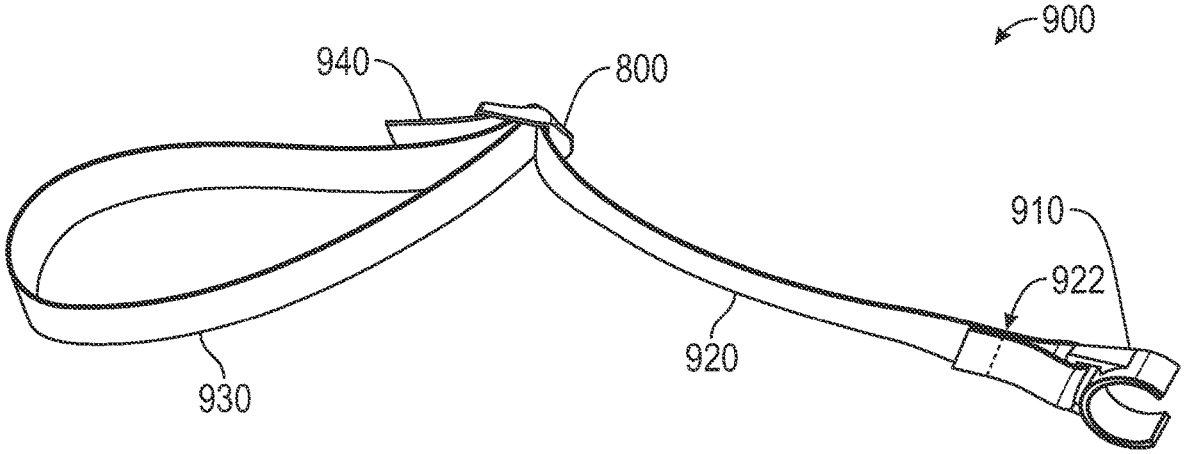
FIG. 9 is an illustration of a wrist strap configured with the buckle of FIG. 8 providing dual sizing adjustability, according to an embodiment of the present disclosure.

FIG. 8 is an illustration of a buckle 800 providing dual sizing adjustability of a wrist strap, according to an embodiment of the present disclosure. FIG. 9 is an illustration of a wrist strap 900 configured with the buckle 800 providing dual sizing adjustability, according to an embodiment of the present disclosure. The buckle 800 and the wrist strap 900 correspond generally with the buckle 712 and the wrist strap 700 of FIG. 7, where FIGS. 8 and 9 are provided including only the buckle and strap detail, for additional clarity. It is emphasized that other types of adjustment elements besides the buckle 800 may be used. However, the buckle 800 is a preferred embodiment for wrist straps constructed of a flat strap webbing material.

The buckle 800 is what might be called a "ladder lock slider" design, as it has a ladder-like shape, and provides both sliding adjustability and locking functions. The buckle 800 is formed of a single piece of material—such as a molded plastic. The buckle 800 includes side walls 802 running longitudinally along both sides. An end tab 804 on one end has a shape which can be pulled away from the strap by a finger or thumb of a user in order to loosen or adjust the buckle 800.

In a preferred embodiment, the buckle 800 includes three apertures —810, 812 and 814—which are shaped as slots oriented laterally between the side walls 802. The apertures 810/812/814 are formed between medial cross-members 820 and 822 and two end cross-members. The end tab 804 and its adjoining structure form one of the end cross-members, and a second end cross-member 824 forms the opposite end of the buckle 800. The three apertures 810/812/814 provide complete wrist strap adjustability as discussed below with respect to FIG. 9.

The wrist strap 900 of FIG. 9 includes a clip 910 having the features of the clip 244 and the clip 720 discussed above. An extension portion 920 of the wrist strap 900 provides a user-configurable distance between a loop portion 930 and the clip 910 (and thus the pole). In a preferred embodiment, the clip 910 is permanently coupled to the extension portion 920, such as by being captured within a small loop of the strap material which is formed by stitching 922. Other means of attachment of the clip 910 to the strap material may be readily envisioned.

The buckle 800 provides adjustability of both the length of the extension portion 920 and the size of the loop portion 930, with excess strap material forming a free end 940. For the purposes of this discussion, a "bottom" face of the buckle 800 is the face shown in FIG. 8. When positioned on the wrist strap 900 as shown in FIG. 9, the extension portion 920 feeds up from the bottom of the buckle 800 through the aperture 810, and the strap material wraps over the top of the medial cross-member 820 and back down through the aperture 812. From there, the loop portion 930 is formed, and the strap material feeds back up through the aperture 812 and over the top of the medial cross-member 822, where it then passes down through the aperture 814 to form the free end 940.

The ladder lock design of the buckle 800 provides complete adjustability by feeding strap material through the apertures 810/812/814 as needed. For example, to shorten the extension portion 920, some of the extension portion strap material can be pushed up through the aperture 810 and pulled tight down through the aperture 812 into the loop portion 930. If the additional strap material is not desired in the loop portion 930, an equal amount can be pushed up through the aperture 812 and pulled down into the free end 940. Lengthening of the extension portion 920 can be accomplished in a similar (but opposite) manner, and adjustment of the loop portion 930 can likewise be performed.

While engaged in certain sports, a user may not want to actively use a wrist strap, but may want to keep the wrist strap available on the pole but securely stowed so that the strap is not lost and does not flop around. For this reason, the break-away wrist strap of the present disclosure may include features for stowing the strap on the pole when the strap is not in use.

Figure 10:
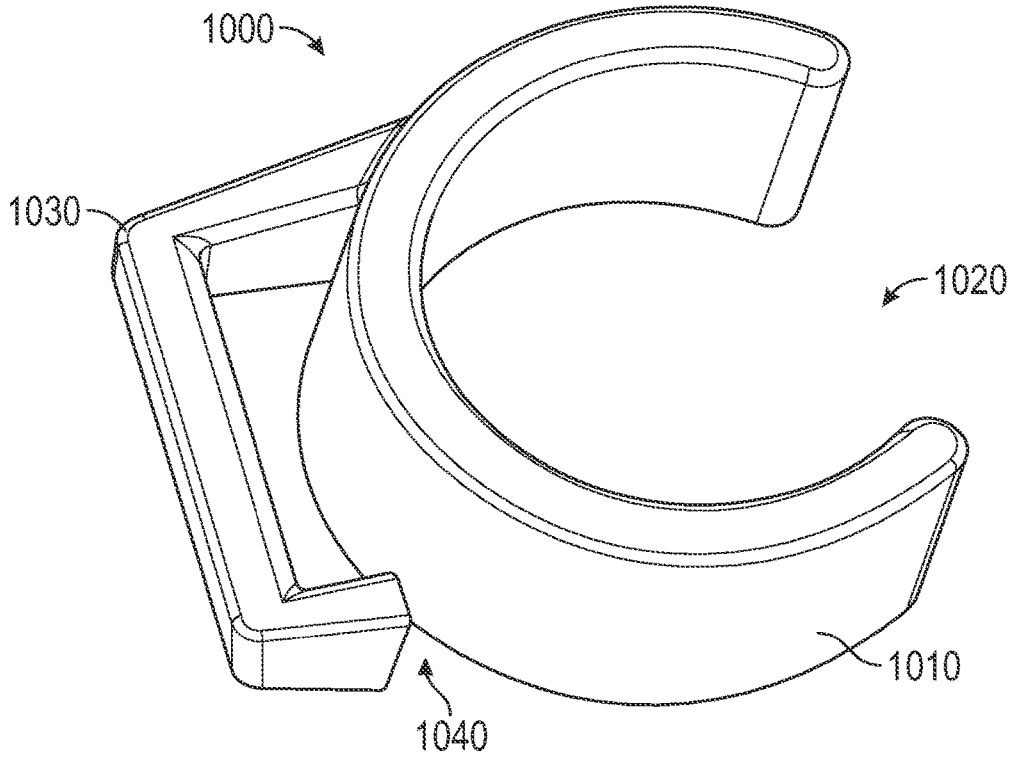
FIG. 10 is an illustration of a clip for detachably coupling a loop end of a wrist strap to a pole, according to an embodiment of the present disclosure.
Figure 11:
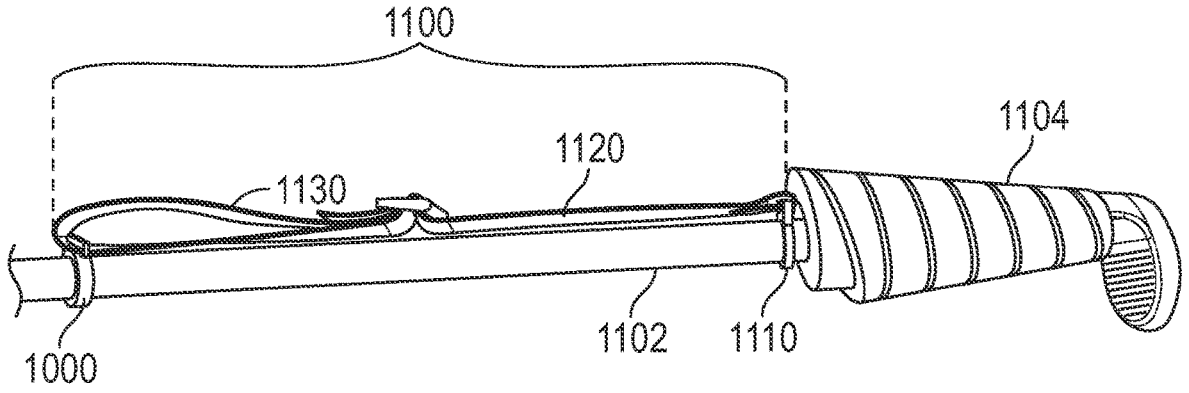
FIG. 11 is an illustration of a wrist strap stowed against a pole using the clip of FIG. 10, according to an embodiment of the present disclosure.

FIG. 10 is an illustration of a storage clip 1000 for detachably coupling a loop end of a wrist strap to a pole, according to an embodiment of the present disclosure. FIG. 11 is an illustration of a wrist strap 1100 stowed against a pole using the clip 1000, according to an embodiment of the present disclosure.

The storage clip 1000 has a body 1010 formed in a C-shape with an opening 1020. The C-shaped body 1010 and the opening 1020 are designed to enable a snap fit of the storage clip 1000 onto a pole (e.g., ski pole or trekking pole). The storage clip 1000 also includes a hook 1030 positioned outside the C-shape of the body 1010, opposite the opening 1020. The hook 1030 is attached to (integral with) the body 1010 on one end, with a gap 1040 on the opposite end. The hook 1030 is offset from the body 1010 just far enough for a wrist strap to be slipped into the gap 1040 and captured by the hook 1030. The gap 1040 is sized so that one thickness of the webbing material of the wrist strap 1100 will just fit through the gap 1040, possibly requiring a slight frictional interference to be overcome. This minimal gap design prevents the wrist strap 1100 from inadvertently becoming disconnected from the storage clip 1000 during user activity.

The storage clip 1000 is preferably constructed of a single molded piece of plastic or hard rubber, but may also be made of metal or another suitable material. The storage clip 1000 is designed to withstand many cycles of elastic deformation when being snapped onto and off of the pole, and the storage clip 1000 will not easily break if snagged or compressed.

In FIG. 11, the wrist strap 1100 includes a main clip 1110 for attachment of the strap 1100 to a pole 1102, in the manner described earlier with respect to FIGS. 7A/B and 9. The pole 1102 is shown with the conical primary grip 1104 discussed in detail earlier. The wrist strap 1100 also includes an extension portion 1120 and a loop portion 1130, as in strap designs discussed earlier. The storage clip 1000 holds the "loose end" of the wrist strap 1100 against the pole 1102, where the loose end is the end of the loop portion 1130 when pulled tight.

As shown in FIG. 11, the storage clip 1000 is snapped onto the pole 1102 and the webbing material of the wrist strap 1100 is captured by the hook 1030 of the storage clip 1000. The storage clip 1000 can be positioned by sliding up and down the pole 1102. In order to stow the wrist strap 1100, the user can slide the storage clip 1000 a short distance up the pole 1102, insert the webbing material of the wrist strap 1100 into the gap 1040 such that the webbing material is looped over the hook 1030, then slide the storage clip 1000 back down the pole 1102 until the wrist strap 1100 is taut. Gripping friction between the storage clip 1000 and the pole 1102 prevents unintended sliding of the storage clip 1000 back up the pole 1102 during user activity. This design is simple and effective for stowing the wrist strap 1100 securely out of the way, no matter the size of the loop portion 1130.

In the event that the wrist strap 1100 is snagged or pulled sharply (such as if the user falls while skiing or hiking), the storage clip 1000 will detach or break away from the pole 1102. The main clip 1110 may also detach or break away in such a situation, depending on the location and direction of the wrist strap tension force. In any case, the breakaway feature of the main clip 1110 and the storage clip 1000 prevent the user's hand from being trapped against the pole in a manner which could cause an injury.

The passive design of the hook 1030 of the storage clip 1000 could be replaced with a clasp design having a pivotable element which captures the strap material, similar to a necklace clasp. This would prevent accidental escape of the strap material from the clasp, but the storage clip would still be detachable from the pole under tensile load (using the C-shape snap-on design shown in FIG. 10) for safety reasons.

In another embodiment, the clip 1000 could be modified to form a hook with a concave shape oriented toward the bottom of the pole, and a small elastic band could be added to the loop portion of the wrist strap—where the elastic band on the wrist strap is placed over the hook on the storage clip to fully secure the wrist strap to the pole. In all of the embodiments discussed above, the clip 1000 (and its equivalents) snap-fits onto the outside of the pole and can be slid up or down the pole as needed to attach the loop portion of the wrist strap and then pull the wrist strap into a tight stowed position.

Other strap stowage embodiments may also be envisioned instead of the clip 1000. For example, a small magnet or a snap could be used to attach the loop portion of the wrist strap to the pole. Alternately, a removable elastic band or hook-and-loop strap could be used to capture the loop end of the wrist strap against the pole for stowage. In all of these embodiments, one end of the wrist strap is secured to the pole adjacent to the grip via the main clip 1110 (or the clip 910 of FIG. 9), while the other end of the wrist strap (the loop end) is secured to the pole using the secondary attachment means—so that the wrist strap is held securely against the pole, with no unwanted swinging around and no risk of accidental detachment and loss of the wrist strap.

All of the wrist strap embodiments discussed above were based on construction from a flat strap material, such as woven nylon webbing. Other materials may be used for the "tensile element" in constructing a break-away pole strap having the same advantageous features—including the break-away design, adjustability of the extension portion length and the loop portion size, and a storage clip or equivalent feature for stowing the entire wrist strap against the pole when the strap is not in use.

Figure 12:
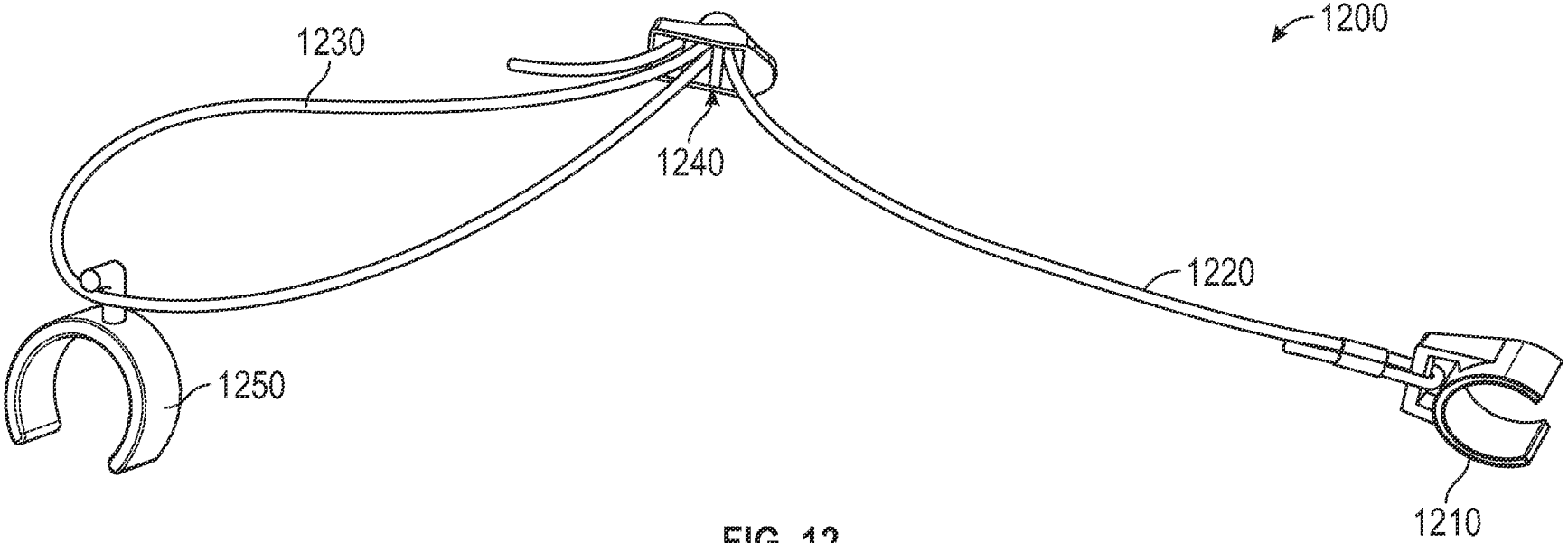
FIG. 12 is an illustration of a detachable wrist strap made of a round cord material rather than a flat webbing material, according to an embodiment of the present disclosure.

FIG. 12 is an illustration of a detachable wrist strap 1200 where the tensile element is made of a round cord material (similar to paracord) rather than a flat webbing material, according to an embodiment of the present disclosure. The wrist strap 1200 is configured with a main clip 1210 for detachably coupling the strap 1200 to a pole (not shown). The cord material of the wrist strap 1200 may be coupled to the main clip 1210 in any suitable fashion, such as by crimping with a ferrule as shown. The wrist strap 1200 includes an extension portion 1220 and a loop portion 1230, in the same fashion as shown and described in earlier embodiments. A toggle 1240 is used to independently adjust the size of both the extension portion 1220 and the loop portion 1230. The toggle 1240 is one embodiment of a device which provides independent adjustment of the extension portion 1220 and the loop portion 1230, and is suitable for use with a round cord material.

A storage clip 1250 is shown near the end of the loop portion 1230. The storage clip 1250 is used for securely stowing the wrist strap 1200 against the pole when wrist strap usage is not needed. The storage clip 1250 has a hook 1252 which in one embodiment may have a 90° elbow shape designed to fit the round cross-section of the wrist strap 1200, where the loop portion 1230 is placed over the hook 1252 and the storage clip 1250 is then slid down the pole until the wrist strap 1200 is taut.

Figure 13:
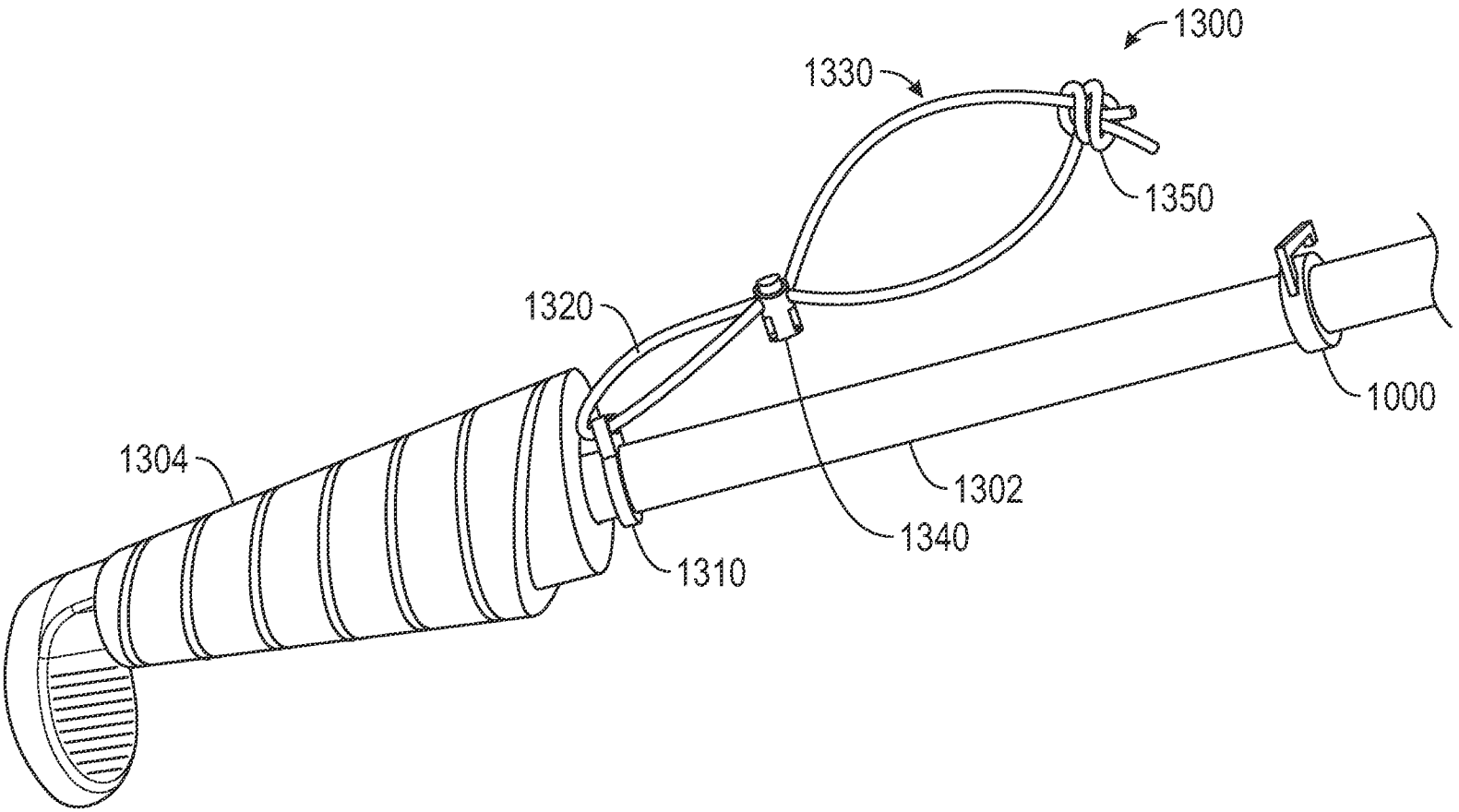
FIG. 13 is an illustration of a detachable wrist strap made of a round cord material, with a toggle device providing slidable adjustment of an extension portion and a loop portion, according to an embodiment of the present disclosure.

FIG. 13 is an illustration of a detachable wrist strap 1300 made of a round cord material, with a toggle device providing slidable adjustment of an extension portion and a loop portion, according to an embodiment of the present disclosure. Like the wrist strap 1200 of FIG. 12, the wrist strap 1300 is preferably constructed of a "paracord"-type material—a braided nylon cord generally having a smooth surface and high tensile stiffness. The wrist strap 1300 is shown along with a pole 1302 and a conical main grip 1304, as discussed earlier with respect to other embodiments.

In FIG. 13, the wrist strap 1300 includes a main clip 1310 for attachment of the strap 1300 to the pole 1302. The wrist strap 1300 also includes an extension portion 1320 and a loop portion 1330, as in the other wrist strap designs discussed earlier.

Unlike earlier wrist strap embodiments, the wrist strap 1300 is made from a loop of the cord material, separated into the extension portion 1320 and the loop portion 1330 by an adjustment device 1340. In this embodiment, the adjustment device 1340 is a push-button "toggle", which can be slidably repositioned by pushing the button, where moving the adjustment device 1340 adjusts the sizes of the extension portion 1320 and the loop portion 1330. The loop which forms the entire body of the wrist strap 1300 may be created simply by tying a knot 1350 in the two loose ends. A ferrule or other element could be used instead of a knot to couple the two loose ends of the cord. The knot 1350 or other coupling element could be located on the loop end of the wrist strap 1300 (as shown), or on the other end proximal the clip 1310.

The storage clip 1000 (of FIG. 10) is also shown attached to the pole 1302, some distance below the main grip 1304. FIG. 13 shows the strap 1300 configured as being ready for use by a person (not stowed). When strap stowage is desired by the user, the end of the wrist strap 1300 (opposite the main clip 1310) is placed in the hook of the storage clip 1000, which holds the wrist strap 1300 against the pole 1302 (as shown with a different wrist strap in FIG. 11). A storage clip having a different design, such as the clip 1250 of FIG. 12, could also be used with the wrist strap 1300 which is made of round cord material. Other storage means may also be used for holding the strap 1300 flat against the pole 1302, as discussed earlier.

Various embodiments of break-away wrist straps are shown in the figures and discussed above. In each of these embodiments, a main clip is provided for detachably coupling the wrist strap to the (skiing or trekking) pole below the hand grip, where the break-away feature prevents injuries such as skier's thumb which result from the user's hand being trapped against the pole and under the body during a fall. The wrist straps include an extension portion and a loop portion which are adjustable to accommodate any size body, arm and hand. A storage clip or storage means may be provided for any wrist strap embodiment, enabling simple and secure storage of the wrist strap tight against the pole when the wrist strap is not needed for a particular activity. The disclosed break-away wrist straps are particularly advantageous when used with a conical primary grip as described earlier, as the conical grip provides a pole thrust mechanism which eliminates the need to apply thrust through a wrist strap.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A break-away wrist strap for a pole, said wrist strap comprising a tensile element, an adjustment element and a clip, where the tensile element is configured into a wrist loop and an extension portion by the adjustment element, the size of the wrist loop and the length of the extension portion being adjustable by the adjustment element, and the extension portion extends from the adjustment element to the clip attached to an end of the tensile element, and where the clip has a shape designed to detachably couple to the pole by elastically deforming to snap-fit over an outer diameter of the pole, the wrist strap further comprising a storage clip configured for coupling to the pole and for receiving a segment of the tensile element in order to secure the wrist strap in a substantially fixed position alongside a length of the pole.

2. The wrist strap according to claim 1 wherein the tensile element is made of a flat strap webbing material.

3. The wrist strap according to claim 2 wherein the adjustment element is a compound buckle enabling independent adjustment of the size of the wrist loop and the length of the extension portion.

4. The wrist strap according to claim 1 wherein the tensile element is made of a round cord.

5. The wrist strap according to claim 4 wherein the adjustment element is a push-button toggle slidably positionable along the tensile element enabling adjustment of the size of the wrist loop and the length of the extension portion.

6. The wrist strap according to claim 1 wherein at least part of the wrist loop has a padding material affixed to or fitted over the tensile element.

7. The wrist strap according to claim 1 wherein the clip has a C-shape with internal walls forming a portion of a cylinder having a diameter smaller than the outer diameter of the pole.

8. The wrist strap according to claim 7 wherein a material of construction, the diameter and wall thickness dimensions of the clip are chosen to result in a break-away force in a defined range, where the break-away force is a tensile force which causes the clip to detach from the pole.

9. The wrist strap according to claim 1 wherein the pole is configured for use in an activity including one or more of hiking, trekking, walking, snow skiing, and splitboarding.

10. The wrist strap according to claim 1 wherein the pole has a grip element fitted over an upper end of the pole, and the wrist strap is configured for attachment of the clip to the pole at a location proximal a lower end of the grip element.

11. The wrist strap according to claim 10 wherein the grip element includes a grip body having a conical shape with an upper end of a smaller diameter and the lower of a larger diameter, where the grip body is fitted over the upper end of the pole, and the grip element has a grip top positioned above the upper end of the grip body, the grip top having a rounded top surface blending into a rear face of the conical shape at the upper end of the grip body with no overhang, and a front flange overhanging a front face of the grip body.

12. The wrist strap according to claim 11 wherein the grip element has a recess formed into the lower end of the grip body, where the recess has a size and shape configured to receive a finger of a user's hand which is wrapped around the grip body.

13. The wrist strap according to claim 11 further comprising a secondary grip element positioned below the grip element on the pole, the secondary grip element having a conical shape over most of its length, with a smaller diameter located at a top end proximal the grip element, and where the wrist strap is configured for attachment of the clip to the pole at a location between the grip element and the secondary grip element.

14. The wrist strap according to claim 1 wherein the storage clip is configured for snap fit onto and slidable positioning along the pole, the storage clip including a hook element shaped to receive the segment of the tensile element in the wrist loop and thereby hold the wrist strap in the substantially fixed position alongside the length of the pole.

15. A grip system for a pole, said grip system comprising:

a primary grip element including a grip body having a conical shape with a smaller diameter first end and a larger diameter second end, where the grip body is fitted over a top end of a pole with the second end nearer a bottom tip of the pole, and the primary grip element has a grip top positioned above the first end of the grip body, the grip top having a rounded top surface blending into a rear face of the conical shape at the first end of the grip body with no overhang, and a front flange overhanging a front face of the grip body, and where the primary grip element has a recess formed into the second end of the grip body, where the recess has a size and shape configured to receive a finger of a user's hand which is wrapped around the grip body; and a break-away wrist strap, said wrist strap comprising a tensile element, an adjustment element and a clip, where the tensile element is configured into a wrist loop and an extension portion by the adjustment element, the size of the wrist loop and the length of the extension portion being adjustable by the adjustment element, and the extension portion extends from the adjustment element to the clip attached to an end of the tensile element, and where the clip has a shape designed to detachably couple to the pole below the primary grip element by elastically deforming to snap-fit over an outer diameter of the pole.

16. The grip system according to claim 15 wherein the tensile element is made of a flat strap webbing material, and where the adjustment element is a compound buckle enabling independent adjustment of the size of the wrist loop and the length of the extension portion.

17. The grip system according to claim 15 wherein the tensile element is made of a round cord, and where the adjustment element is a push-button toggle slidably positionable along the tensile element enabling adjustment of the size of the wrist loop and the length of the extension portion.

18. The grip system according to claim 15 wherein the clip has a C-shape with internal walls forming a portion of a cylinder having a diameter smaller than the outer diameter of the pole, and where a material of construction, the diameter and wall thickness dimensions of the clip are chosen to result in a break-away force in a defined range, where the break-away force is a tensile force which causes the clip to detach from the pole.

19. The grip system according to claim 15 further comprising a storage clip configured for snap fit onto and slidable positioning along the pole, the storage clip including a hook element shaped to receive a segment of the tensile element in the wrist loop and thereby hold the wrist strap in a substantially fixed position alongside a length of the pole.

20. A grip system for a pole, said grip system comprising:

a primary grip element including a grip body having a conical shape with a smaller diameter first end and a larger diameter second end, where the grip body is fitted over a top end of a pole with the second end nearer a bottom tip of the pole, and the primary grip element has a grip top positioned above the first end of the grip body, the grip top having a rounded top surface blending into a rear face of the conical shape at the first end of the grip body with no overhang, and a front flange overhanging a front face of the grip body, and where the primary grip element has a recess formed into the second end of the grip body, where the recess has a size and shape configured to receive a finger of a user's hand which is wrapped around the grip body;

a secondary grip element positioned below the primary grip element on the pole, the secondary grip element having a conical shape over most of its length, with a smaller diameter located at a top end proximal the primary grip element; and a break-away wrist strap, said wrist strap comprising a tensile element, an adjustment element and a clip, where the tensile element is configured into a wrist loop and an extension portion by the adjustment element, the size of the wrist loop and the length of the extension portion being adjustable by the adjustment element, and the extension portion extends from the adjustment element to the clip attached to an end of the tensile element, and where the clip has a shape designed to detachably couple to the pole below the primary grip element by elastically deforming to snap-fit over an outer diameter of the pole.

21. The grip system according to claim 20 wherein the tensile element is made of a flat strap webbing material, and where the adjustment element is a compound buckle enabling independent adjustment of the size of the wrist loop and the length of the extension portion.

22. The grip system according to claim 20 wherein the tensile element is made of a round cord, and where the adjustment element is a push-button toggle slidably positionable along the tensile element enabling adjustment of the size of the wrist loop and the length of the extension portion.

23. The grip system according to claim 20 wherein the clip has a C-shape with internal walls forming a portion of a cylinder having a diameter smaller than the outer diameter of the pole, and where a material of construction, the diameter and wall thickness dimensions of the clip are chosen to result in a break-away force in a defined range, where the break-away force is a tensile force which causes the clip to detach from the pole.

24. The grip system according to claim 20 further comprising a storage clip configured for snap fit onto and slidable positioning along the pole, the storage clip including a hook element shaped to receive a segment of the tensile element in the wrist loop and thereby hold the wrist strap in a substantially fixed position alongside a length of the pole.

* * * * *